US012624902B2

(12) United States Patent
Brooks

(10) Patent No.: US 12,624,902 B2
(45) Date of Patent: May 12, 2026

(54) MODULAR THERMAL ENERGY STORAGE AND TRANSFER IN A PCM HOSTING SYSTEM

(71) Applicant: Barry Richard Brooks, Pilot Hill, CA (US)

(72) Inventor: Barry Richard Brooks, Pilot Hill, CA (US)

( * ) Notice: Subject to any disclaimer, the term of this patent is extended or adjusted under 35 U.S.C. 154(b) by 0 days.

(21) Appl. No.: 19/232,382

(22) Filed: Jun. 9, 2025

(65) Prior Publication Data

US 2025/0321061 A1 Oct. 16, 2025

Related U.S. Application Data

(63) Continuation-in-part of application No. 18/989,373, filed on Dec. 20, 2024, now Pat. No. 12,339,020, and (Continued)

(51) Int. Cl.
*F28D 20/02* (2006.01)
*F28D 20/00* (2006.01)

(52) U.S. Cl.
CPC ..... *F28D 20/026* (2013.01); *F28D 20/028* (2013.01); *F28D 2020/0082* (2013.01)

(58) Field of Classification Search
CPC ..... F28D 20/026; F28D 20/028; F28D 2020/082; F28D 2020/00; (Continued)

(56) References Cited

U.S. PATENT DOCUMENTS 5,507,337 A 4/1996 Rafalovich et al.
8,522,859 B2 9/2013 Moilala et al.
(Continued)

FOREIGN PATENT DOCUMENTS

CN 111306973 A 6/2020
WO WO 2019/171087 9/2019
(Continued)

OTHER PUBLICATIONS

Pdf is translation of foreign reference WO 2019179197 A1 (Year: 2019).*
(Continued)

*Primary Examiner* — Len Tran
*Assistant Examiner* — Kamran Tavakoldavani

(57) ABSTRACT

The disclosed embodiments disclose a modular seasonal thermal-energy storage and transfer system that includes an energy-storage module (ESM) with a plurality of chambers that contain phase-change material (PCM) that stores thermal energy. An energy fluid is routed through the ESM, and the temperature of the energy fluid triggers a phase change in the PCM to transfer energy between the PCM and the energy fluid. A control mechanism can adjust the flow of the energy fluid through the ESM to efficiently achieve a target temperature change either in the energy fluid (e.g., using the ESM to access stored energy from the PCM) or in the PCM (e.g., use thermal energy in the energy fluid to store energy in the PCM). The disclosed techniques facilitate the charging and use of a flexible, modular year-round hot and cold energy storage.

12 Claims, 19 Drawing Sheets

Related U.S. Application Data a continuation-in-part of application No. 18/218,044, filed on Jul. 4, 2023, now Pat. No. 12,326,281.

(60) Provisional application No. 63/658,540, filed on Jun. 11, 2024, provisional application No. 63/613,468, filed on Dec. 21, 2023, provisional application No. 63/389,537, filed on Jul. 15, 2022.

(58) Field of Classification Search
CPC ..... F28D 2020/0047; C09K 5/063; F28F 21/084; F28F 21/02; F28F 21/04; F28F 21/08
See application file for complete search history.

(56) References Cited

U.S. PATENT DOCUMENTS

| | | | | |
|---|---|---|---|---|
| 9,841,243 | B2 | 12/2017 | Oliva Llena et al. | |
| 10,072,896 | B2 | 9/2018 | Jacobs et al. | |
| 10,088,243 | B2 | 10/2018 | Grama et al. | |
| 10,660,236 | B2 * | 5/2020 | Rush | G06F 1/20 |
| 11,015,877 | B2 | 5/2021 | McKellar et al. | |
| 11,415,341 | B1 | 8/2022 | Melia et al. | |
| 11,530,877 | B2 * | 12/2022 | Jansen | C07C 9/22 |
| 2010/0000707 | A1 | 1/2010 | Tsubone et al. | |
| 2011/0162829 | A1 | 7/2011 | Xiang | |
| 2012/0279679 | A1 | 11/2012 | Soukhojak et al. | |
| 2016/0212878 | A1 * | 7/2016 | Quinn | H05K 7/2039 |
| 2019/0101337 | A1 | 4/2019 | Dhanabalan et al. | |
| 2020/0126890 | A1 * | 4/2020 | Singh | H01L 23/427 |
| 2021/0168970 | A1 * | 6/2021 | Chehade | H05K 7/20327 |
| 2021/0190438 | A1 * | 6/2021 | Pranov | F28D 20/0056 |
| 2021/0207895 | A1 | 7/2021 | Bissell et al. | |
| 2021/0331834 | A1 * | 10/2021 | Longley | B65D 81/3897 |
| 2022/0107137 | A1 * | 4/2022 | Li | H01L 23/427 |

FOREIGN PATENT DOCUMENTS

| | | | | |
|---|---|---|---|---|
| WO | WO-2019179197 A1 * | 9/2019 | | F28D 20/021 |
| WO | WO-2022259716 A1 * | 12/2022 | | F28D 15/046 |

OTHER PUBLICATIONS

Pdf is translation of foreign reference WO 2022259716 A1 (Year: 2022).*

DOE/Buiding Technology Office/DE-EE0010911—2022/2023 "Low Cost and High-Performance Modular Thermal Energy Storage for Building Equipment".

Martin Ruiz/ Senior Engineering Project, 2016/ YouTube Video www.youtube.com/watch?v=VdagQ5_cx7c.

* cited by examiner

MODULAR THERMAL ENERGY STORAGE AND TRANSFER IN A PCM HOSTING SYSTEM

RELATED APPLICATIONS

This application is a continuation-in-part of pending U.S. patent application Ser. No. 18/218,044, entitled "Add-On Apparatus for Converting a Conventional Air-Source Refrigeration Cycle for Multiple Heat Transfer Options," by inventor Barry Richard Brooks and filed on 4 Jul. 2023. U.S. patent application Ser. No. 18/218,044 claims priority under 35 U.S.C. § 119(e) to U.S. Provisional Patent Application No. 63/389,537, by inventor Barry Richard Brooks, entitled "Appendage Heat Transfer Enabling Apparatus," filed 15 Jul. 2022. This application is also a continuation-in-part of pending U.S. patent application Ser. No. 18/989,373, entitled "Smart Controls for Hybrid Refrigeration Cycles," by inventor Barry Richard Brooks and filed on 20 Dec. 2024. U.S. patent application Ser. No. 18/989,373 claims priority under 35 U.S.C. § 119(e) to U.S. Provisional Patent Application No. 63/613,468, by inventor Barry Richard Brooks, entitled "Integrating Applications and Methods of Self-Learning and Reasoning Smart Controls for Aftermarket Hybrid Refrigeration Cycles," filed 21 Dec. 2023. This application also claims the benefit of U.S. Provisional Patent Application No. 63/658,540, by inventor Barry Richard Brooks, entitled "Modular Energy Storage and Transfer System," filed 11 Jun. 2024. The contents of all of the above-referenced applications are hereby incorporated by reference.

BACKGROUND

Field of the Invention

This disclosure relates generally to energy systems, and more particularly to modular thermal energy storage and transfer systems that host phase change materials (PCMs) that facilitate both hot and cold temperature conditioning capabilities.

Related Art

Energy, and more specifically the use and source of it, has come to the forefront of our daily lives in most of the world's societies. Due to climate change governments and policy makers recognize the need to reduce the dependency on fossil fuels as it relates to the daily lives of its citizenry. One approach has been the governed shift to all electric appliances. California, US, for example, is implementing building codes that require electric heat pumps for heating and cooling of homes and light commercial buildings. A negating factor with heat pumps are the inefficiencies of these appliances during peak summer and winter conditions. Utilities are granted the ability to charge more to customers during these peak periods. This is partially because a utility's source of electricity may not be sufficient to meet demands during peak conditions. It is and will continue to be a challenge for utilities to prevent brown or black outs, along with uncertainty and high cost to consumers. This California utility and consumer dilemma will continue and will spread to other states in the US.

Load-shifting technologies for residences and commercial applications attempt to collect hot and cold thermal energy during off-peak hours for use in offsetting peak demands. However, current technologies are limited to solar photovoltaic panels with battery backup for energy storage, which offer an expensive and singular approach to solving the load shifting dilemma.

Hence, what is needed are techniques for providing energy storage without the above-described problems of existing techniques.

SUMMARY OF THE INVENTION

The disclosed embodiments disclose a modular seasonal thermal-energy storage and transfer system that includes an energy-storage module (ESM) with a plurality of chambers that contain phase-change material (PCM) that stores thermal energy. An energy fluid is routed through the ESM, and the temperature of the energy fluid triggers a phase change in the PCM to transfer thermal energy between the PCM and the energy fluid. A control mechanism can adjust the flow of the energy fluid through the ESM to efficiently achieve a target temperature change either in the energy fluid (e.g., using the ESM to access stored thermal energy from the PCM) or in the PCM (e.g., use thermal energy in the energy fluid to store thermal energy in the PCM). The disclosed techniques facilitate the charging and use of a flexible, modular year-round hot and cold energy storage.

In some embodiments, the control mechanism adjusts the flow rate of the energy fluid through the PCM to maximize a temperature difference between the energy fluid and the PCM to enable a uniform phase change across the PCM of the ESM.

In some embodiments, the ESM includes a module-housing body that includes: an external vertical side surface with a top and bottom surface; an internal partition that bisects the module-housing body into a first fluid chamber and an adjacent fluid chamber, wherein the internal partition has an opening that facilitates energy fluid transfer between the first internal fluid chamber and the adjacent fluid chamber; an inlet that penetrates the module-housing body into the first fluid chamber; an outlet that penetrates the module-housing body into the adjacent fluid chamber; a first set of PCM encapsulated in the first fluid chamber; and a second set of PCM encapsulated in the adjacent fluid chamber. Energy fluid is injected into the ESM via the inlet, flows through the first fluid chamber exchanging thermal energy with the first set of PCM, flows through the opening to the adjacent fluid chamber, flows through the adjacent fluid chamber exchanging thermal energy with the second set of PCM, and then flows through the outlet out of the ESM. Note that the flow of the energy fluid in the adjacent fluid chamber is opposite in direction to fluid flow in the first fluid chamber.

In some embodiments, the ESM includes a module-housing body that includes four equal vertical surface sides with a top and bottom surface and a partition structure that diagonally quadrisects the module-housing body into four fluid chambers-a first fluid chamber, a second fluid chamber, a third fluid chamber, and a fourth fluid chamber. Each of the four adjacent fluid chambers includes: encapsulated PCM secured in a support structure; a first fluid-mixing area above the support structure; and a second fluid-mixing area below the support structure. The module-housing body also includes an inlet that penetrates the module-housing body into the first fluid chamber and an outlet that penetrates the module-housing body into the fourth fluid chamber. A first section of the partition wall separating the first fluid chamber and the second fluid chamber is porous to fluid flow, and a second section of the partition wall separating the third fluid chamber and the fourth fluid chamber is porous to fluid flow.

Furthermore, the partition structure comprises a first opening that facilitates fluid transfer between the second fluid chamber and the third fluid chamber. Energy fluid injected into the ESM via the inlet flows through the first fluid chamber exchanging thermal energy with the first chamber's PCM, flows through the porous first section; flows through the second fluid chamber exchanging thermal energy with the second chamber's PCM, flows through the first opening to the third fluid chamber, flows through the third fluid chamber exchanging thermal energy with the third chamber's PCM, flows through the second section to the fourth fluid chamber, flows through the fourth fluid chamber exchanging thermal energy with the fourth chamber's PCM, and then flows through the outlet out of the ESM. Note that the flow of the energy fluid in the first and second fluid chamber is opposite in direction to fluid flow in the third fluid chamber and the fourth fluid chamber. Note also that the first section and second section provide structural support to the ESM without impeding fluid flow, thereby making the ESM substantially function as a two-chamber structure.

In some embodiments, the system includes a plurality of ESMs and an interconnecting energy-fluid-routing mechanism between the pluralities of ESMs that is leveraged by the control mechanism to control the flow of the energy fluid through the plurality of ESMs.

In some embodiments, the interconnecting energy-fluid-conveying system includes an actuatable valve that facilitates reversing fluid flows through the inlets and outlets of one or more of the ESMs. The control mechanism is configured to reverse the flow of the energy fluid through a given ESM at least once to increase the residence time of the energy fluid within the given ESM and thereby increase the uniformity of a phase change for the PCM in the given ESM.

In some embodiments, the plurality of ESMs are a heterogeneous set of independent ESMs with different PCM types and chamber configurations. The control mechanism tracks the state and characteristics of each of these heterogeneous ESMs, and can adjust the flow velocity of the energy fluid through a given ESM in the plurality based on characteristics of the PCM type and PCM layout in the given ESM to customize the residence time of the energy fluid in the ESM and thereby maximize thermal transfer and trigger a PCM state change.

In some embodiments, a set of isolation valves at the inlets and outlets of the plurality of ESMs facilitate selectively routing the energy fluid through segregated subsets of the plurality of ESMs. The control mechanism configures the set of isolation valves to store and access two or more distinct temperature levels of stored thermal energy across segregated subsets of the plurality of ESMs.

In some embodiments, the ESM includes a module-housing body that includes four equal vertical surface sides with a top and bottom surface and a partition structure that diagonally quadrisects the module-housing body into four fluid chambers-a first fluid chamber, a second fluid chamber, a third fluid chamber, and a fourth fluid chamber. Each of the four adjacent fluid chambers includes: encapsulated PCM secured in a support structure; a first fluid-mixing area above the support structure; and a second fluid-mixing area below the support structure. The module-housing body also includes an inlet that penetrates the module-housing body into the first fluid chamber and an outlet that penetrates the module-housing body into the fourth fluid chamber. The partition includes: a first opening that facilitates fluid transfer between the first fluid chamber and the second fluid chamber; a second opening that facilitates fluid transfer between the second fluid chamber and the third fluid chamber; and a third opening that facilitates fluid transfer between the third fluid chamber and the fourth fluid chamber. Energy fluid injected into the ESM via the inlet flows through the first fluid chamber exchanging thermal energy with the first chamber's PCM, flows through the first opening to the second fluid chamber, flows through the second fluid chamber exchanging thermal energy with the second chamber's PCM, flows through the second opening to the third fluid chamber, flows through the third fluid chamber exchanging thermal energy with the third chamber's PCM, flows through the third opening to the fourth fluid chamber, flows through the fourth fluid chamber exchanging thermal energy with the fourth chamber's PCM, and then flows through the outlet out of the ESM. Note that the flow of the energy fluid in the first fluid chamber and the third fluid chamber is opposite in direction to fluid flow in the second fluid chamber and the fourth fluid chamber.

In some embodiments, the openings between chambers are located at opposing extremes of each adjacent chamber to maximize a fluid flow path through the ESM, thereby maximizing the path of the energy fluid through the ESM and the energy transfer between the energy fluid and the PCM in the ESM.

In some embodiments, the openings in the partition structure that separates the chambers comprise increase in area from the center of the module-housing body towards the outside perimeter of the module-housing body. Increasing the area of the openings in the partition structure routes the energy fluid evenly across changing velocity and static pressures throughout the ESM to balance fluid flows and thermal energy transfer through the chambers of the ESM.

In some embodiments, the PCM in the ESM is substantially positioned in each energy fluid congruent chamber by a retaining support system. The retaining support system, the shape of the PCM, and the layout of the PCM in each chamber are configured to maximize the surface area of the PCM that is exposed the energy fluid and achieve a desired energy fluid flow that maximizes energy transfer between the PCM and the energy fluid.

In some embodiments, the PCM in the ESM comprises a range of geometric shapes and configurations to optimize the amount and layout of PCM within and between chambers of the ESM.

One disclosed embodiment discloses a technique for accessing a seasonal energy storage system (SESS) in accordance with an embodiment. The SESS comprises a plurality of ESMs, wherein each ESM comprises a plurality of chambers that contain PCM that can store thermal energy. During operation, a control mechanism for the SESS tracks thermal state for the plurality of ESMs. Subsequently, the control mechanism receives a request for thermal energy for a thermal target (e.g., at least one of an energy sink and an energy source). The control mechanism determines from the request and the tracked thermal state a candidate set of one or more ESMs in the plurality that can provide the requested thermal energy, and determines for an energy fluid a flow rate and a temperature differential that ensures a phase change in the PCMs of the candidate set that will efficiently transfer the requested thermal energy between the PCMs and the energy fluid. The system then uses an energy-fluid-routing mechanism for the SESS to pump the energy fluid through the candidate set and the thermal target at the flow rate to transfer the requested thermal energy.

The details of one or more variations of the subject matter described herein are set forth in the accompanying drawings and the description below. Other features and advantages of the subject matter described herein will be apparent from the description and drawings, and from the claims. While certain features of the currently disclosed subject matter are described for illustrative purposes, it should be readily understood that such features are not intended to be limiting. The claims that follow this disclosure are intended to define the scope of the protected subject matter.

BRIEF DESCRIPTION OF THE FIGURES

The accompanying drawings, which are incorporated in and constitute a part of this specification, show certain exemplary embodiments and aspects of the subject matter disclosed herein and, together with the description, help explain some of the principles associated with the disclosed implementations.

FIG. 2A illustrates a counter-clockwise flow, while FIG. 2B illustrates a clockwise flow.

Note that when practical, similar reference numbers denote similar structures, features, or elements.

DETAILED DESCRIPTION

Figure 1:
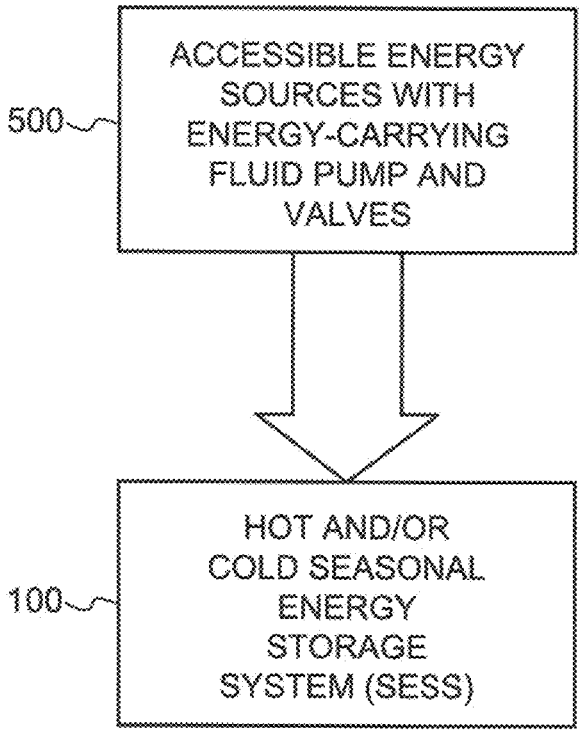
FIG. 1 illustrates a two-block diagram illustrating the relationship between an accessible and independent energy source controlled by a piping, valving, and pumping system and the disclosed seasonal energy storage system (SESS) in accordance with an embodiment.

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not limited to the embodiments shown, but is to be accorded the widest scope consistent with the principles and features disclosed herein.

Any data structures and code described in this detailed description are typically stored on a non-transitory computer-readable storage medium, which may be any device or non-transitory medium that can store code and/or data for use by a computer system. The non-transitory computer-readable storage medium includes, but is not limited to, volatile memory, non-volatile memory, magnetic and optical storage devices such as disk drives, magnetic tape, CDs (compact discs), DVDs (digital versatile discs or digital video discs), or other media capable of storing code and/or data now known or later developed.

One or more methods and processes described in the detailed description section can be embodied as code and/or data, which can be stored in a non-transitory computer-readable storage medium as described above. When a computer system reads and executes the code and/or data stored on the non-transitory computer-readable storage medium, the computer system performs the methods and processes embodied as data structures and code and stored within the non-transitory computer-readable storage medium.

Furthermore, one or more methods and processes described below can be included in hardware modules. For example, the hardware modules can include, but are not limited to, application-specific integrated circuit (ASIC) chips, a full-custom implementation as part of an integrated circuit (or another type of hardware implementation on an integrated circuit), field-programmable gate arrays (FPGAs), a dedicated or shared processor that executes a particular software module or a piece of code at a particular time, and/or other programmable-logic devices now known or later developed. When the hardware modules are activated, the hardware modules perform the methods and processes included within the hardware modules.

Energy Storage Systems

Some embodiments of the present invention comprise systems, methods and articles of manufacture for providing load-shifting capabilities by storing thermal energy in a low-cost energy-storage system with an energy-retaining medium. More specifically, the disclosed techniques provide a modular and expandable energy storage system in which PCMs are encapsulated into geometric shapes enclosed within the host housing of one or more energy storage module (ESM) units arranged to allow movement of an energy fluid. The energy fluid provides a liquid medium for energy throughout multiple interconnected heat exchange processes as well as an ESM. Multiple individual ESMs may be interconnected with piping to create two or more directional passes within each ESM.

Generally, a number of mediums can be used to store thermal energy. For example, thermal energy storage systems can include heat transfer materials, such as liquids, solids, water, water/glycol mix, sand, stones, and/or the like, that absorb, store, and dissipate energy. Liquids generally provide better heat transfer characteristics than solids, but may still be limited in heat transfer performance by the configuration of the energy storage system in which heat transfer material is used. Many heat transfer materials exhibit poor thermal conductivity characteristics and store one of either hot or cold energy, but not both simultaneously within the same system. Further, many energy storage systems are limited by their large storage sizes (e.g., in physical size), which limits the types of applications in which the energy storage systems may be used. For example, water allows for freezing, thereby providing advantage of latent energy storage for cooling applications only. In another example, water may be heated and stored in a domestic hot water heater or other insulated storage tank. Some embodiments can leverage the use of liquid-to-solid or reverse phase-change materials (PCMs) that by their definition include both latent and sensible energy capabilities that encompass both hot and cold conditions. Such PCMs may facilitate reducing the size of an energy storage system.

For example, in some embodiments PCMs are available that offer melting points in a range more suited for residential and commercial applications, e.g. from 50-80° F. Paraffin wax, for example, satisfies this requirement; however, paraffin wax has a low thermal conductivity characteristic. Hence, paraffin wax PCMs may include embedded nanobeads of aluminum for improved heat transfer. Paraffin wax may also include fire retardants that enable safely using the material. A number of similar PCMs that are available include organics (paraffin and non-paraffin), inorganics (salt hydrates), and eutectics (organic-organic, inorganic-inorganic, and (inorganic-organic). Each have characteristic advantages and disadvantages based on factors such as their melting points, latent energy values, density, thermal conductivity, method/technique of application, flammability, and cost.

In some embodiments, encapsulated PCMs can be manufactured in a three-dimensional flat configuration that is placed in an air stream for energy absorption or release. Alternatively, encapsulated PCMs submerged in a flowing liquid energy fluid environment (in a similar configuration to that of nuclear control rods in a water storage pool without directional fluid flow) can take advantage of both sensible energy and latent energy. Other examples include impregnating of thermoplastic with PCM to eliminate the need for encapsulating metal containment. Another common manufactured product consists of PCM impregnated wall board installed on internal space walls and ceilings. A range of efforts strive to improve on the limitations of existing materials, but significant challenges exist.

The development of cost effective PCMs that improve on the limitations to existing materials available is evident by the US Department of Energy funding of a consortium of three US national laboratories in the development of PCMs for energy storage systems and construction materials. Referred to as the Stor4Build program, this program is under the direction of the Energy Building Technologies Office. As new materials are developed for both the public and private sector, significant challenges exists. The materials developed require cost effective encapsulation and energy storage management. In addition, any encapsulated material must have the maximum temperature differential by a heat transfer fluid in order for melting or solidifying of the medium to take place. Encased diverting methods, therefore, must have the ability to sustain this maximum temperature differential as much as practical.

One limitation of existing encapsulated PCMs is the use of a single directional energy fluid (gas or liquid) to either absorb from or dissipate energy to the fluid and an encapsulated PCM. An example is to simply place encapsulated PCM in tubes in a container where no directional controlled flow is provided. As this approach is equivalent to a heat exchanger in singular flow direction, the greatest temperature differential ($\Delta T$) is at the inlet, with the smallest $\Delta T$ at the outlet. The result is uneven distribution of energy throughout the encapsulated PCM. Prior art also limits itself to a PCM where the energy fluid flows through tubing embedded within the PCM. Some embodiments comprise a mechanical hosting system by which the thermal characteristics of PCMs are maximized.

Eutectic phase-change materials generally have identical melting and solidification temperatures for each type manufactured. Manufactured types for space conditioning applications will generally be selected to range near the internal space temperature conditions desired, which may differ depending on a climate zone. The temperature of the energy carrying fluid, therefore, must be above or below the phase-change-rated temperature in order to shift energy. A greater temperature difference will more rapidly change the phase of the PCM. In additional, the watts-per-unit-time requirements needed for energy-fluid pumping is lower with greater differential temperatures (e.g., less energy fluid needs to be pumped if there is a larger temperature differential).

As outdoor conditions change hourly and seasonally, charging a PCM requires energy transfer to rapidly take place as energy sources become available. Because of the generally poor of thermal conductivity of PCM, placing them in small diameter cross-sectional area tubes in close proximities to each other creates the most heat-transfer surface area of selected geometries.

Some embodiments provide a modular energy storage system that can be sized for a range of applications by hosting encapsulated PCMs in multiple geometric shapes. In such embodiments, the modular energy storage system can maximize and adapt to the thermal characteristics of a PCM. Such a system can be used to provide a seasonal energy storage system (SESS) with energy fluid and diverting capabilities that include multidirectional flow and modular selection. Such a design can be leveraged in residential and commercial applications with modularity, expandability, and selectability (e.g., selective decisions on whether and how to use such a system based on environmental parameters and predictions). The capabilities of such an SESS can be determined and leveraged by an adaptive control system that uses tracking and learning techniques to maximize energy savings.

FIG. 1 illustrates a general representation of a thermal energy storage system and its relationship with an energy source and related components. Common thermal energy sources and sinks available include hybrid heat pumps and thermal solar panels. Accessible energy source 500 may include, therefore, a warm or hot energy source or a cool or cold energy source. Included with any energy source or sink are pumps, piping, valves, and controls that access the energy source via an energy fluid. An energy storage system, therefore, has at least one inlet and one outlet with at least one energy fluid loop. Energy fluid may be water, water/glycol, oil, chemical mixtures, or two-phase refrigerants and is defined as the fluid that carries energy to and from the storage system. In FIG. 1, seasonal energy storage system 100 is defined as a seasonal energy storage system (SESS) with at least one energy fluid and at least one inlet and one outlet. In this example, the energy fluid is a single-phase liquid. In some embodiments, SESS 100 includes an energy fluid flow reversing mechanism. Furthermore, some embodiments may include one or more energy storage modules (ESMs) that include directional fluid flow separated by multiple internal chambers (as described and illustrated below). Different chambers within these multiple chambers may employ multiple and/or different encapsulating methods containing multiple PCM types, as determined by a manufacturer.

As stated above, PCMs generally have poor thermal conductivity, heat transfer, and low-latent energy characteristics. In some embodiments, three key design factors facilitate optimizing efficient heat transfer to and from a PCM to address these limitations: 1) surface area, 2) maintaining a maximum temperature difference (as described above), and 3) flow rate. Surface area in some embodiments is defined as the fixed amount of PCM surface area an energy-carrying fluid has contact with during an exposure time (e.g., the time from when the energy-carrying fluid enters a PCM structure until it exits the structure, independent of the number of chambers in which PCM is stored). When designing a structure, the available surface area for exchange is a fixed area determined, in part, based on the efficiency of the PCM. Maximum temperature difference throughout the SESS may be achieved by alternating the inlet and outlet of the energy carrying fluid, to ensure that ideally all of the areas of the PCM throughout the structure experience temperature differentials and change phase. Energy fluid may also be cycled through the PCM structure a number of times to maximize the temperature exchange over time over time (e.g., either by reversing the flow one or more times to allow longer exchange type, or by cycling through the entire system to get new charged energy fluid by going through a pump and an independent heat exchange system to an external source/sink). Alternatively, flow rate may be adjusted to improve the residence time of the energy fluid within a chamber. Flow rate may be fixed or variable; a variable flow rate may be preferred as a reduced flow rate can impact on how rapidly the SESS can be charged or depleted of energy. Other options for maximizing temperature exchange can include increasing the number of chambers; increasing the thickness of the PCM exposed to the energy fluid; increasing the heat transfer surface area; and maintaining the highest $\Delta T$ possible throughout a module. Increasing the residence time and improving heat-exchange characteristics facilitates maximizing the amount of energy transfer given time and space limitations. Note that the lowest temperature difference would typically be in the center of the residence surface area, where radiant temperatures may aid in heat transfer.

Note that temperature transfer considerations also have a reverse correlation to the external source or sink of energy. For instance, when an energy-carrying fluid is extracting energy from a thermal solar panel, for example, the lower the returning fluid temperature to the panel at its inlet the greater the temperature differential and, therefore, the greater the heat (energy) absorption. In some embodiments, the control logic that determines the speed of a variable speed pump may consider the temperature transfer characteristics on both sides (e.g., both the temperature transfer in the SESS and in the external source/sink) when determining the variable speed settings to maximize overall efficiency and power savings.

In some embodiments, a modular and expandable SESS may comprise one or more ESM units, and a single given ESM unit may comprise one or more of the following:

- a rectangular shape having four sides with a top and bottom structure;
- a geometric shape having multiple sides with a top and bottom structure;
- a round shape with a top and bottom structure;
- a structure comprised of one or more of thermoplastic, cellulose, composite, or metal;
- an energy fluid that comes in contact with encapsulated PCM;
- a single partition wall running internally the vertical length of the ESM unit creating two equal chambers;
- two or more partition walls running internally and the vertical length intersecting at the center of the ESM unit creating four or more equal-sized chambers, with the chambers providing substantial areas to host encapsulated PCMs;
- one or more partition walls made of a rigid material with openings that allow fluid flow between chambers;
- at least two chambers having fluid inlets or outlets at or near the top of the ESM unit;
- mixing areas at the top and bottom of a chamber that facilitate the energy fluid equalizing temperature differences;
- partitions that comprise two opposing sides and a supporting system to host encapsulated PCM on each side of a partition;
- a supporting system inside of the outer walls of the PCM that facilitates hosting encapsulated PCM;
- encapsulating techniques and structures for PCM that comprise a hollow cavity constructed of corrugated metal, plastic, or wall board;
- a racking system within each chamber to hold encapsulating tubes running internally nearly the vertical length of the ESM in close proximity to each other, wherein the encapsulating tubes may be round, square, or other geometric cross-sectional shapes;
- a racking system within each chamber to hold flat rectangular sheets of material encapsulating PCM in close proximity to each other;
- external tubing connections that attach externally to a connection tubing serving a fluid delivery/receiving header located internally near the top of an ESM unit chamber, wherein the delivery/receiving header may be geometric in loop shape with a single inlet/outlet;
- external tubing allowing energy exchange fluid to flow to and from the ESM unit;
- a penetration at the top of each chamber that serves as an air relief vent; and
- a penetration at the top of each chamber that serves as a liquid drain.

In some embodiments, a flexible, modular, and expandable SESS may comprise multiple ESM units, and this combination of several ESM units may comprise one or more of the following:

- external tubing linked to multiple ESM units in a parallel configuration;

four-way, two-position actuatable valving located externally and serving multiple ESM units configured to direct two-direction flow to and from a combination of ESM units;

two-way actuatable valving located at the inlet and outlet of each ESM units to provide isolation of one or more ESM unit from other ESM units;

two-way actuatable valving located at the inlet and outlet of each ESM units to provide separation between ESM units for hot and cold thermal storage for one or more SESS units;

an independent pumping mechanism to mechanically initiate flow of energy fluid throughout the number of ESM units employed;

one or more sensors embedded in one or more ESM units;

multiple interconnected ESM units located above ground, below ground, and/or mounted on an elevated structure outside and/or inside a space;

multiple interconnected ESM units with insulated exterior walls surrounding the units;

a control system to monitor and track ESM operation and change direction of fluid flow entering and leaving an ESM unit;

adaptive control techniques that monitor, track, and learn the operation, characteristics, and capabilities of the SESS to optimize the efficient use of the SESS.

In some embodiments, the disclosed seasonal energy storage system (SESS) can be configured as a "PCM hosting system" that manages a wide range of PCMs in different configurations to improve heat transfer efficiency and performance and allow for greater heat transfer and energy storage capacity. For instance, the described SESS may be expandable to flexibly include multiple different ESMs, and hence is not limited to a single ESM size or shape. For example, an expandable SESS may connect one or more ESMs via one or more interconnecting features to adapt to various energy storage needs, while still maintaining a relatively low overall profile and withstanding the increased load requirements. Depending on predicted thermal energy needs, some SESS configurations may include a number of parallel, homogeneous ESMs, while other configurations may include heterogeneous ESMs with different numbers of chambers, as well as different PCM types, shapes, surface area, and characteristics (e.g., different PCMs to optimize for storing thermal energy in different temperature ranges). Thus, an expanded SESS can provide both increased thermal energy storage capacity that improves heat transfer performance and/or provide thermal energy storage capacity that can charge and provide thermal energy across a wider temperature range. In some embodiments, an SESS may provide energy storage and heat exchange for multiple heating and cooling applications simultaneously, thereby improving the versatility and use of the thermal energy storage system described herein. Note that maximizing thermal energy transfer for heterogeneous PCMs may involve more complex control logic techniques that need to adjust the energy fluid velocity based on the PCM type and distribution (e.g., the temperature characteristics of the PCM and the transfer surface area of the target enclosures) of the particular ESMs that are being accessed for an energy transfer at a given moment in time.

Figure 2A:
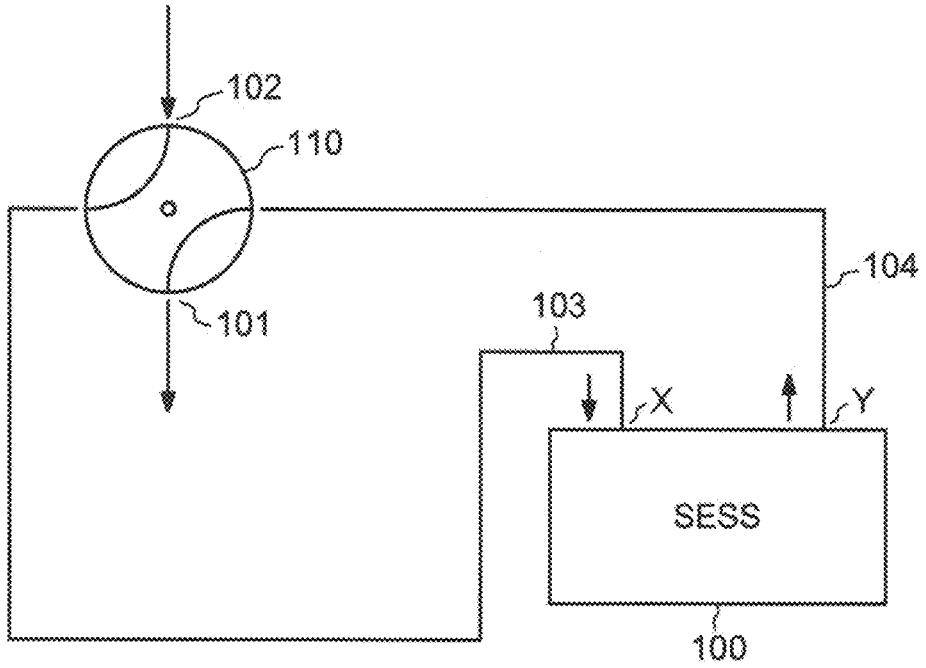
FIGS. 2A and 2B schematically illustrate a valving arrangement that facilitates a bi-directional fluid flow direction in accordance with an embodiment.
Figure 2B:
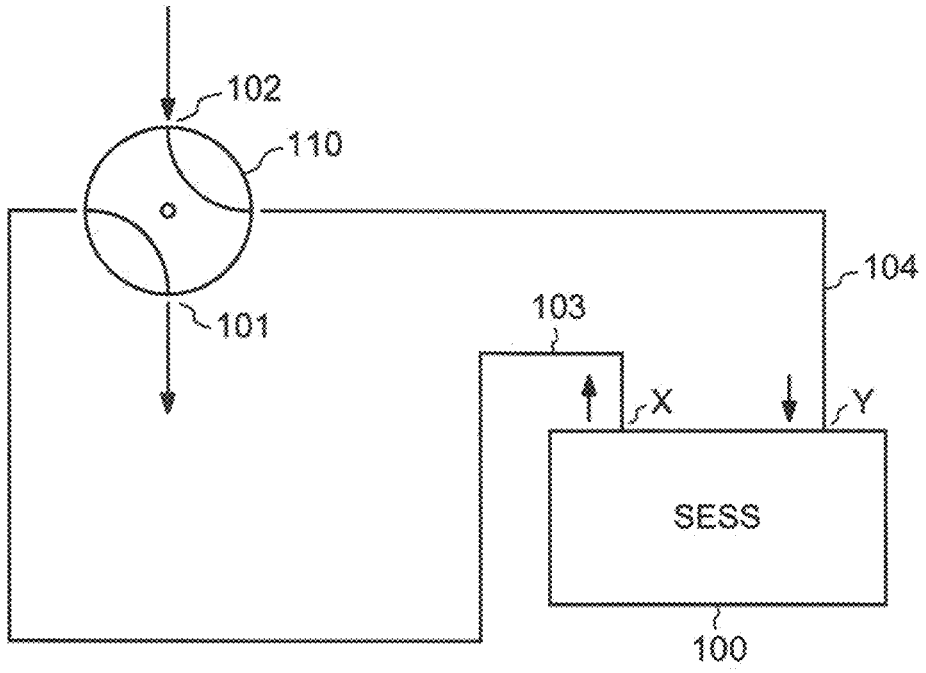

FIGS. 2A and 2B illustrate exemplary system piping diagrams that depict an embodiment of an SESS 100 made up of one or more ESM units 105, consistent with implementations of the current subject matter. Both figures show a four-way, two-position actuatable valve 110 that provides reversing fluid flow direction characteristics. At least one pump included in energy source 500 provides an energy fluid to at least one ESM unit 105. In addition, in FIGS. 2A and 2B, however, pipelines 103 and 104 provide reversing flows into ports X and Y. In FIG. 2A fluid would flow into ESM unit 105 through piping 103 and discharge through piping 104. In FIG. 2B fluid would flow into ESM unit 105 through piping 104 and discharge through piping 103. Valve 110 has an inlet port 102 from the pump discharge and an exit port 101 to the pump suction. The purpose of providing a need for reversing flow capability is disclosed in detail in the following figures.

Figure 3:
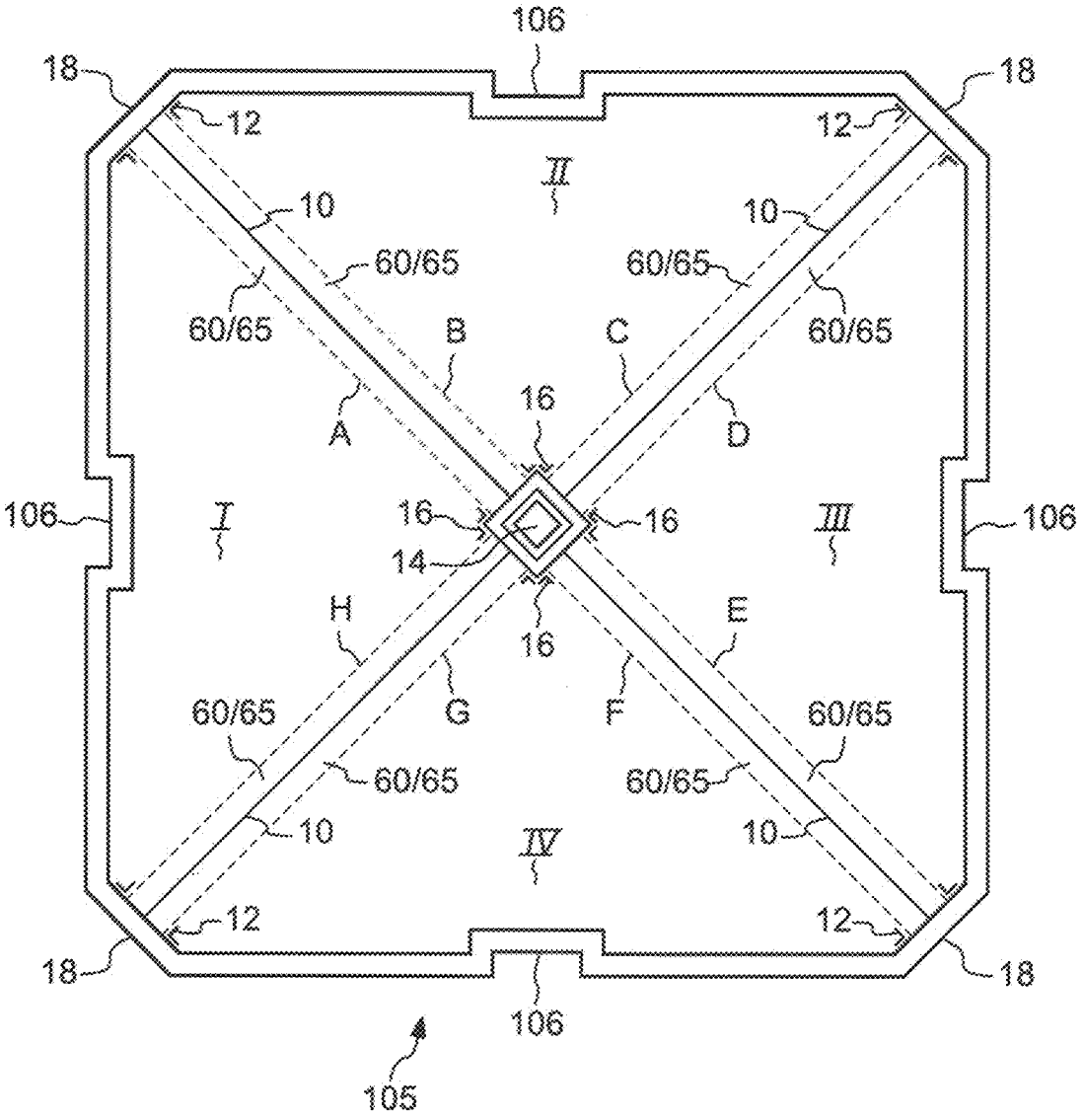
FIG. 3 illustrates an internal horizontal cross sectional view of a single energy storage module (ESM) with four internal fluid chambers in accordance with an embodiment.

FIG. 3 illustrates a horizontal internal detail of a preferred embodiment of an ESM 105. The details of PCMs and the encapsulation thereof are not shown in FIG. 3 to better identify structural and fluid flow details. The illustrated cross section provides a view of four chambers designated as roman numerals I, II, III, and IV. While a range of shapes can be leveraged, ESM 105 is illustrated in FIG. 3 as a square rectangular shape to provide greater stability. ESM 105 may be manufactured using a thermoplastic by rotary or blow molding, for example. These two examples allow for shaping of varying features necessary for strength, stability, and module integrity at minimum manufacturing costs. Specifically, corners 18 are beveled for vertical corner strength and to provide a mounting surface. At least one vertical indentation 106 is provided per side to increase side wall strength.

Figure 8:
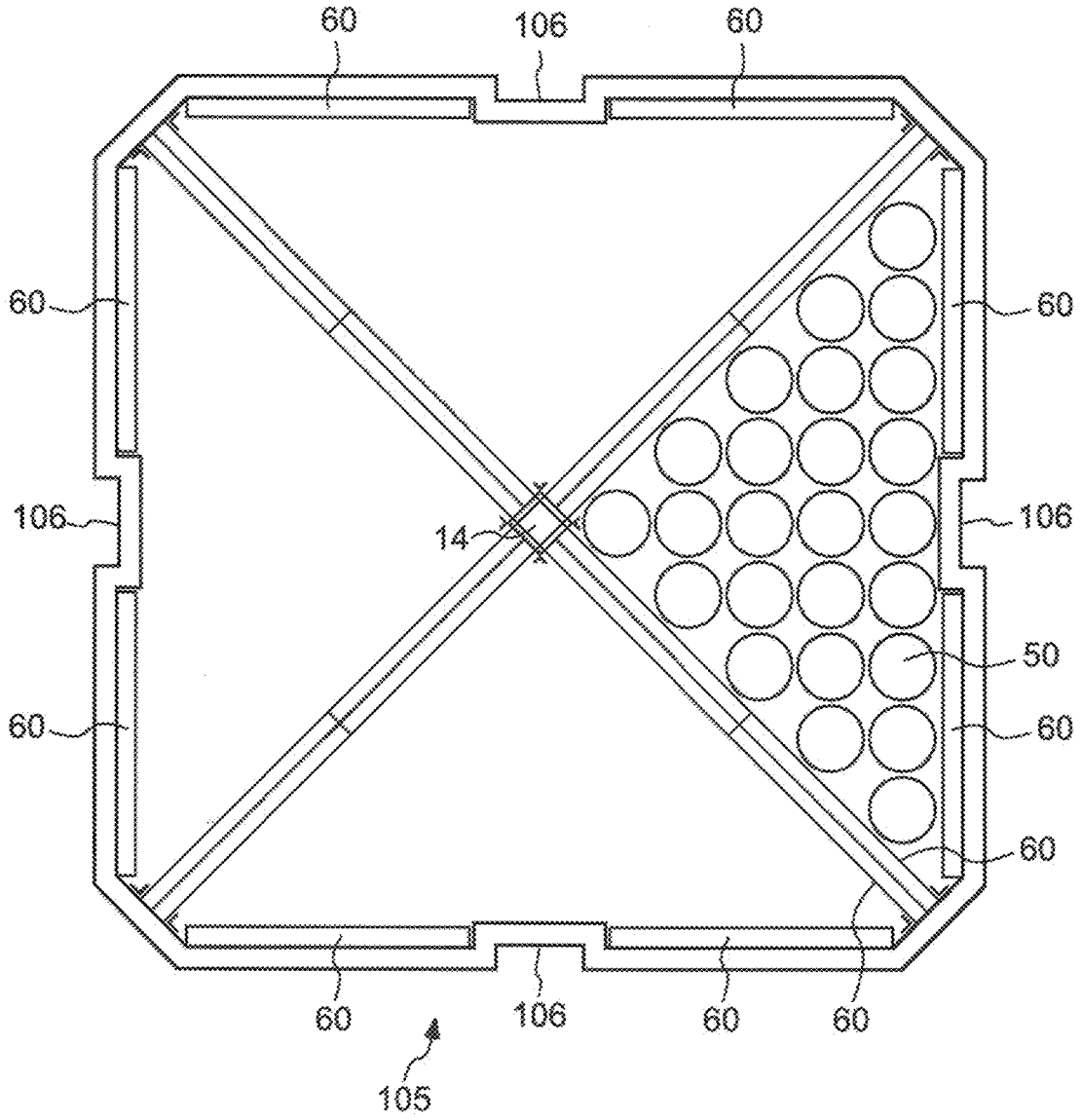
FIG. 8 illustrates an exemplary configuration for an ECM in accordance with an embodiment.
Figure 9:
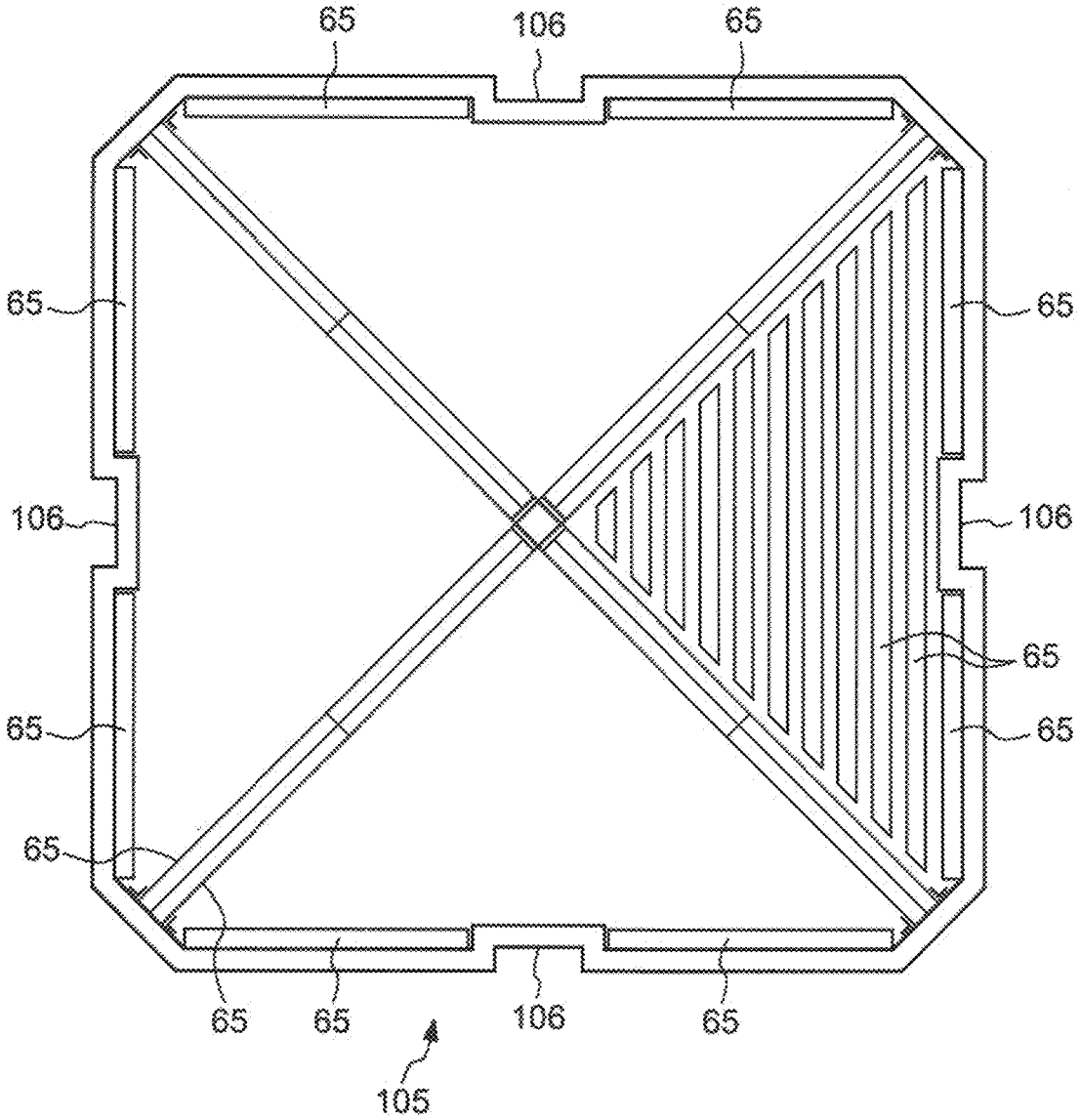
FIG. 9 illustrates a second exemplary configuration for an ECM in accordance with an embodiment.

For the four-chamber ESM 105 illustrated in FIG. 3, the internal components and the method of separating individual chambers with partition walls 10 has four primary functions: (1) provide a partition and necessary energy fluid passages between chambers, (2) provide a host support partition for an encapsulated PCM within a rectangular cavity that is exposed to fluid in each chamber, (3) provide outward force against corner locations 18 to minimize bulging of the side walls, and (4) provide an inlet or outlet area at the top of ESM 105 in any two adjacent triangular chambers. FIG. 3 also illustrates end brackets 12, center brackets 16, and a single square positioning and tensioning tube 14. Reference numbers 60 and 65 (60/65) on the surface of the dashed lines are shown to represent the surfaces of the PCM affixed to partitions walls 10. Details of 60 and 65 are shown in FIGS. 8 and 9.

Figure 4A:
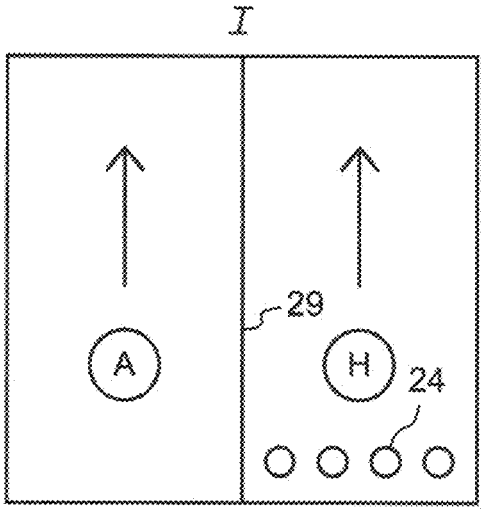
FIGS. 4A, 4B, 4C, and 4D illustrate vertical views of fluid flow through the four internal fluid chambers of the ESM of FIG. 3 in accordance with an embodiment.
Figure 4B:
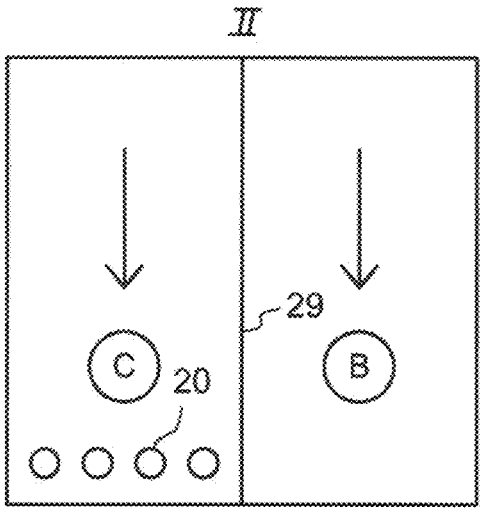
Figure 4C:
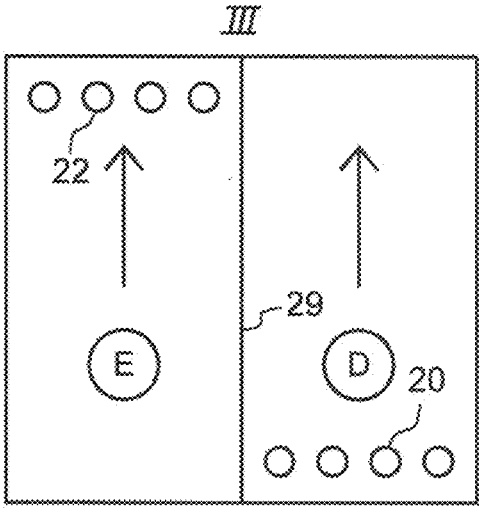
Figure 4D:
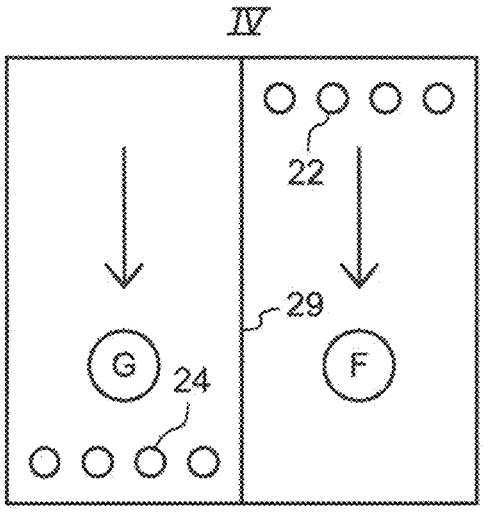
Figure 5A:
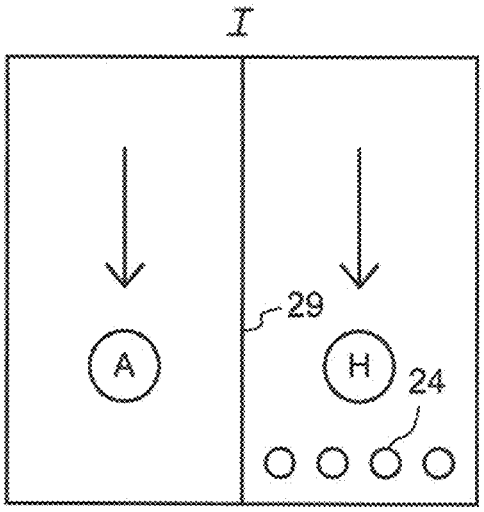
FIGS. 5A, 5B, 5C, and 5D illustrate vertical views of a reverse fluid flow the four internal fluid chambers of the ESM of FIG. 3 in accordance with an embodiment.
Figure 5B:
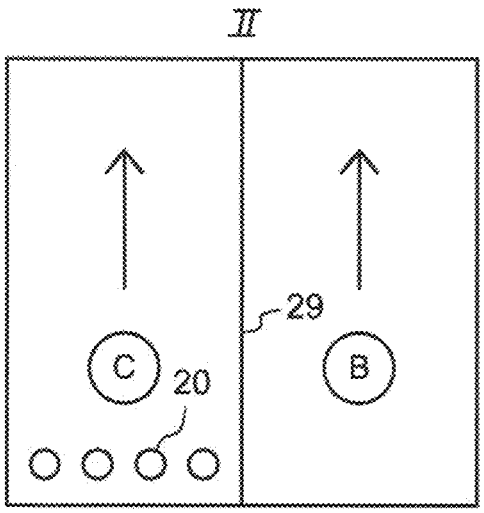
Figure 5C:
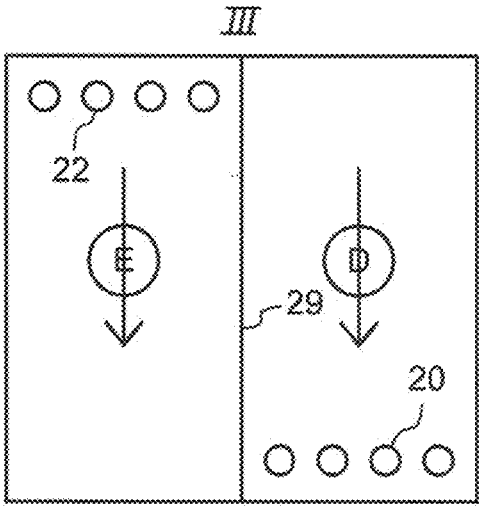
Figure 5D:
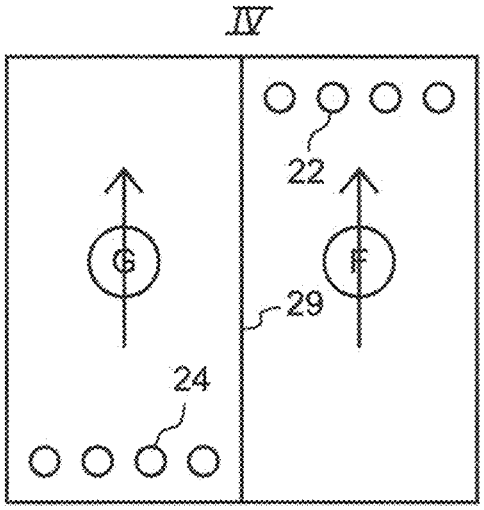

Each side of the separating partitions 10 in FIG. 3 is designated by the letters A-H, which provide the basis for describing the reversing flow paths in FIGS. 4A, 4B, 4C, and 4D and FIGS. 5A, 5B, 5C, and 5D. In FIG. 3, adjacent chambers (e.g., chambers I and II) have at least one piping penetration at the top of each chamber to accommodate the flow of energy fluid through the chambers. In FIGS. 4A-4D and 5A-5D reference 29 indicates partition 10 vertical edges connecting with center tube 14. In FIG. 4B fluid is discharged downward (through an inlet in the ceiling of chamber II) through chamber II with no penetrations in the top portions of surfaces B and C. Fluid flow to adjacent chamber III is provided at the bottom of partition C through penetration 20 into chamber III with partitions D and E as shown in FIG. 4C. Energy fluid travels upward in chamber III to penetration holes 22 into chamber IV. As shown in FIG. 4D, fluid travels downward towards penetration holes 24 at the bottom of chamber IV on the bottom of partition G. The energy fluid now enters chamber I from penetration holes 24 shown in FIG. 4A and subsequently leave the ESM 105 through a second piping penetration at the top of chamber I. In FIGS. 5A-5D, the reverse of FIGS. 4A-4D is illustrated. Chamber I becomes the receiving point for the energy fluid that then flows through chambers IV, III, and then II, and chamber II becomes the discharge chamber. In some of the disclosed embodiments any two adjacent chambers with a common partition wall 10 can provide at least one piping penetration each for either entering or leaving energy fluid.

Note that while ESM 105 in FIGS. 3-5 comprises four chambers, in some embodiments an ESM may include fewer or more chambers. For instance, the structure in FIG. 3 may be modified to only include one partition wall 10 that bisects the area into only two sections (not shown). In such an arrangement, fluid residence time might, for example, be extended in the two chambers by locating the inlet and outlet on the top surface of ESM 105 on opposite sides of the single partition wall 10, the penetrations between the two chambers might be on the opposite bottom of the single partition wall 10 (e.g., diagonally across from the inlet and outlet), and PCM structures may be shaped and placed in a manner that encourages the energy fluid to evenly flow through the different areas of the chambers equally. Alternatively, a two-chamber structure can also be created that includes both sets of partition walls 10 (forming an 'X' as in FIG. 3), but the plane of one of the walls is porous, thereby effectively forming only two chambers from a flow perspective. This arrangement provides the structural stability of the center tube and 'X' partition walls for a two-chamber structure. A range of parameters including different number of chambers, routing options, and PCM shapes and layout can be adjusted to optimize fluid residence time and temperature transfer in ESM 105 to achieve location-, environment- and application-specific requirements.

Figure 6:
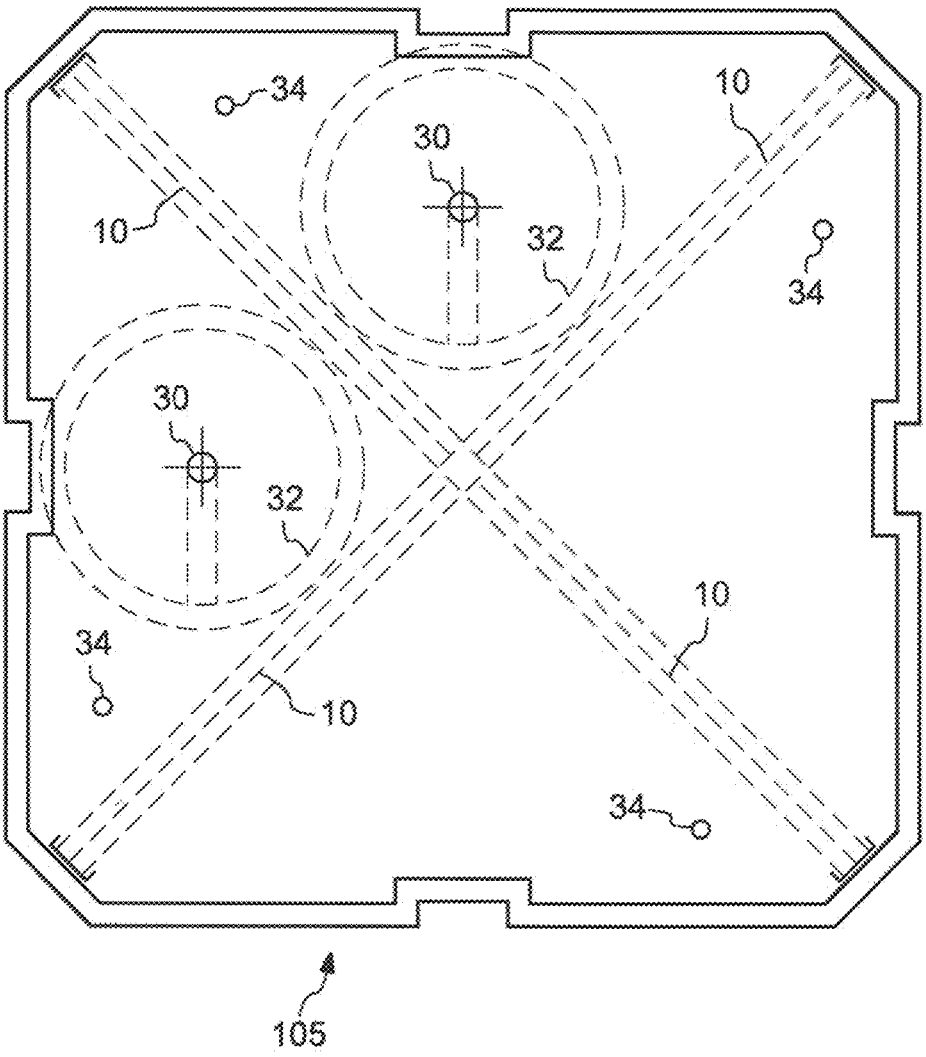
FIG. 6 illustrates a top view of an internal variation of inlet or outlet headers within two chambers of an ESM in accordance with an embodiment.

FIG. 6 illustrates an exemplary option for distributing the entering or leaving energy fluid through at least one penetrating piping per upper chamber. Penetrating pipe 30 feeds a circular annulus 32, for example, with holes creating an even distribution or receiving of the energy fluid. Annulus 32 could also be manufactured in a number of closed loop geometric shapes to maximize even flow of energy fluid. FIG. 6 also illustrates an arbitrary penetration 34 which could accommodate a variety of mechanisms for expelling air from within each upper chamber.

Figure 7:
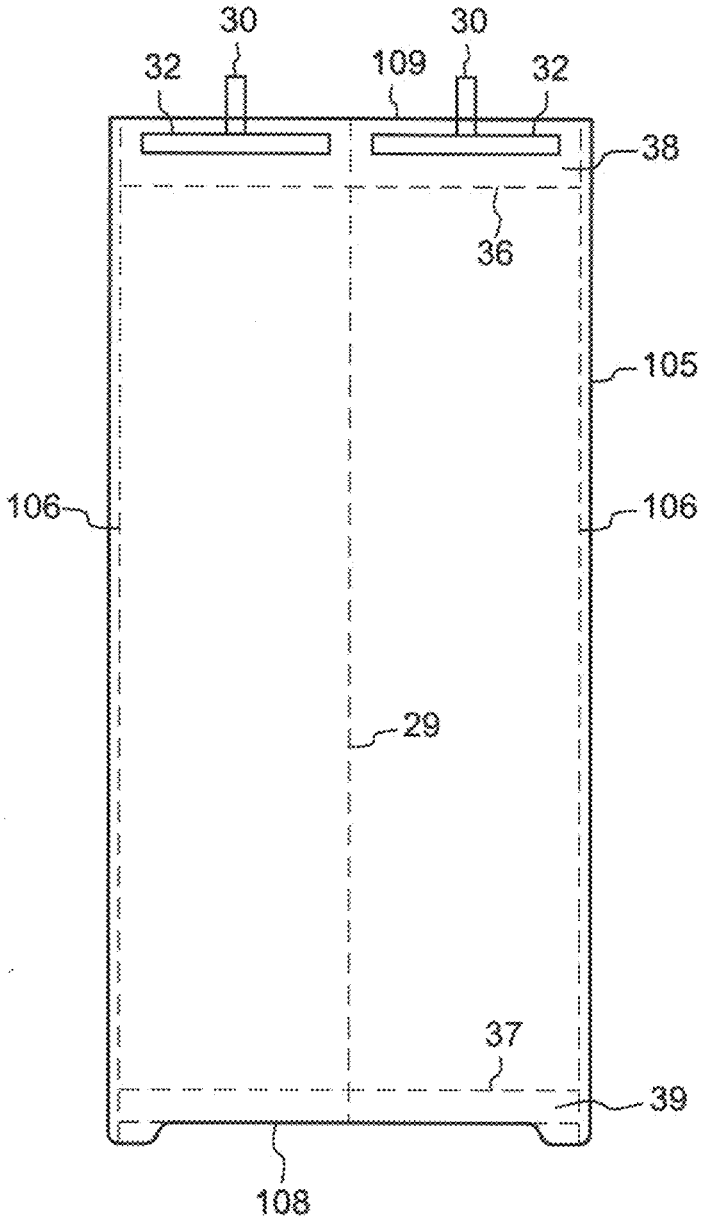
FIG. 7 illustrates a vertical cross-sectional view of an ESM in accordance with an embodiment.

FIG. 7 illustrates a vertical cross-sectional view of ESM 105 that shows additional features of a single ESM. Dashed line 29 represents the center line and a partition wall 10 separating energy fluid reversing inlets and outlets 32 with penetrating piping 30. Dashed lines 36 and 37 represent the top and bottom of any PCM encapsulated material employed in ESM 105. At the bottom of the module 108 represents a strengthening approach to the module to overcome the static water pressure at the bottom. A common reservoir region where energy fluid becomes homogeneous is shown as 38 above the encapsulated PCM and 39 below the encapsulated PCM. The external top on an ESM is referenced as 109.

FIG. 8 illustrates an exemplary configuration for an ECM 105 in which additional PCM materials are encapsulated within a manufactured-to-size enclosure cavity. This exemplary configuration maximizes surface contact area for heat exchange between the energy fluid and a PCM by placing and/or attaching rectangular shapes 60 with a dimensional flat surface on the interior of outer walls of ESM 105 that encapsulate the PCM. In addition, rectangular shapes 60 may be mounted on each side of chamber partitions 10 depicted in FIG. 3. Additionally, rigid tubing in a variety of cross sectional geometric shapes of round, square, and/or hexagon as examples encapsulate the same or different PCM as in rectangular shape 60. The induced energy fluid flows through spaces created around the tubes 50. Tubes 50 may also have different cross-sectional areas within a chamber. The geometric tubes 50 are only shown in one chamber for brevity, whereas multiple and/or all chambers would include geometric tubing when completed.

FIG. 9 illustrates another exemplary configuration for an ECM 105 in which an alternate PCM approach does not rely on retaining containers such round or rectangular tubing enclosures. In FIG. 9, waterproofed sheet boards of varying thicknesses with impregnated PCM are cut to size and installed as shown. The arrangement of sheet boards may vary and provide equivalents. The geometric shapes 65 are only shown in one chamber for brevity whereas multiple and/or all chamber could include geometric plates when completed. Note that the encapsulated PCM can be pre-manufactured as wall board 60 and/or 65, for example, with a variation of sizes cut from large sheet stock. Note also that any combination of 60 and 65 (as well as sheet stock of varying sizes) may be employed within a single or multiple chambers at the discretion of a manufacturer based on a range of constraints.

Figure 10:
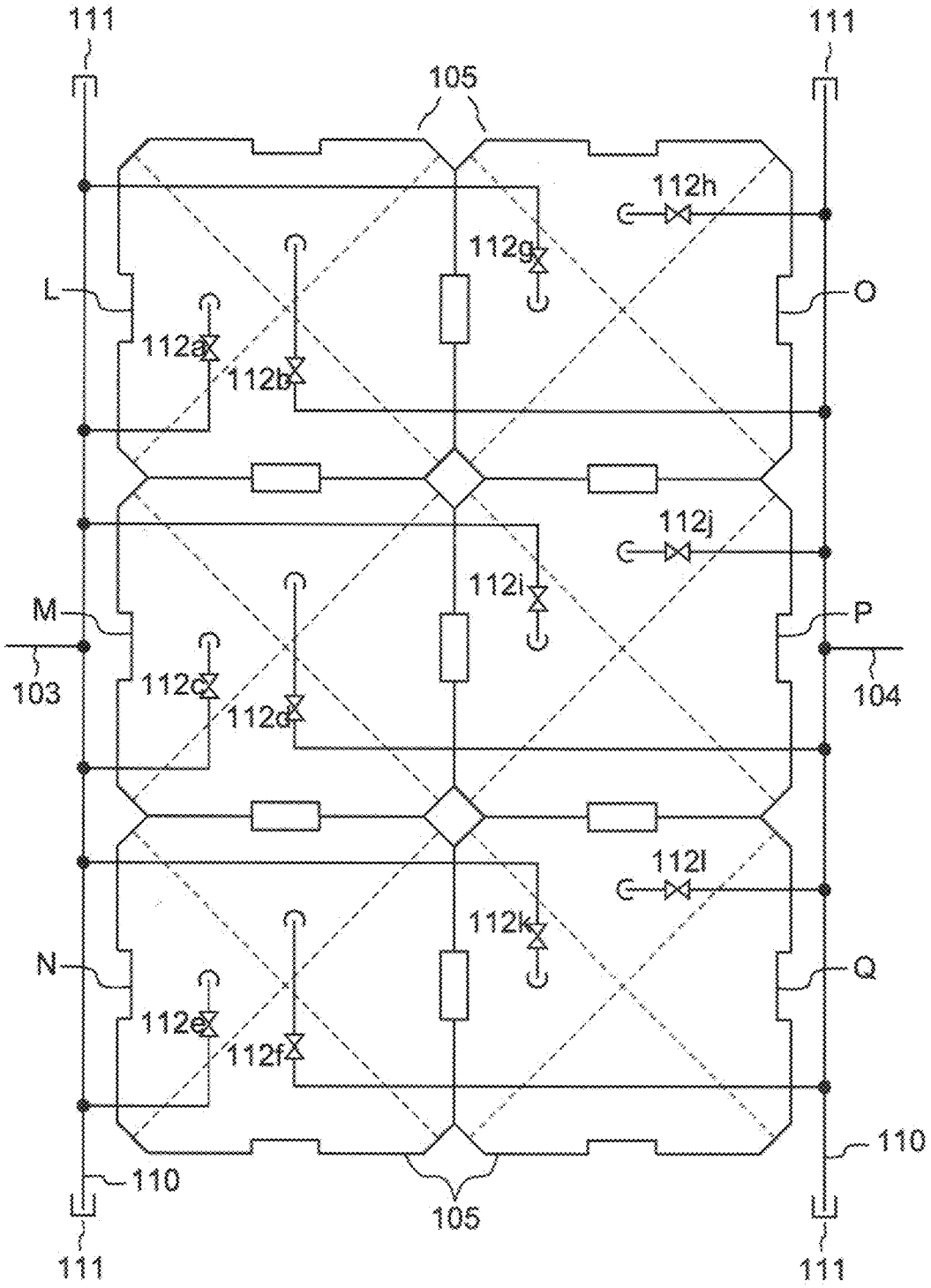
FIG. 10 illustrates multiple ESM units in a variable configuration with interconnected inlet/outlet piping and isolation valves in accordance with an embodiment.

FIG. 10 illustrates an exemplary embodiment in which multiple ESM 105 units are combined with preferred piping and valving. In FIG. 10 six modules are arranged with piping 103 and 104 shown to demonstrate a balanced flow under both inlet and outlet conditions. Piping header lines 110 may be a flexible or rigid piping or tubing header with tees feeding each module. Headers 110 would be capped on the end of each header length shown as 111. Under any configuration normally-closed actuated two-way valves 112 may be installed. For instance, two-way valves 112 could facilitate separating modules to achieve different energy levels during a period of time such that some modules receive cold energy while others receive hot energy. Should the collective modules be configured to always be uniformly either cold or hot energy storage, then valves 112 may be manual.

Further clarification of the benefit of using actuated valves in FIG. 10 is illustrated using valves 112*a*-112*l*. Some embodiments provide the ability through control techniques to alter which module(s) receives hot or cold energy fluid. A twelve-month yearly cycle has both winter and summer months in which 100% hot or cold storage is desirable. However, between these two periods a combination of energy storage may shift sometimes daily where in one instance more heat is desired at night for heating than during a day and conversely more cold storage is desired for cooling during a day than heating at night. The present invention provides selectable combinations where more or fewer individual modules can be accessed based on the time of day and storage requirements. One example of this would be using ESM 105 modules L, M, O, and P for heat storage and ESM 105 modules N and Q for cold storage. Therefore, valves 112*a*, 112*b*, 112*c*, 112*d*, 112*g*, 112*h*, 112I, and 112*j* may open to receive heat energy during a first period of a day and valves 112*e, f, k*, and *l* may be open during another period of the day to receive cold energy. A secondary advantage to this valving arrangement is the ability to remove a module for replacement without losing operational capability of the system.

Figure 11:
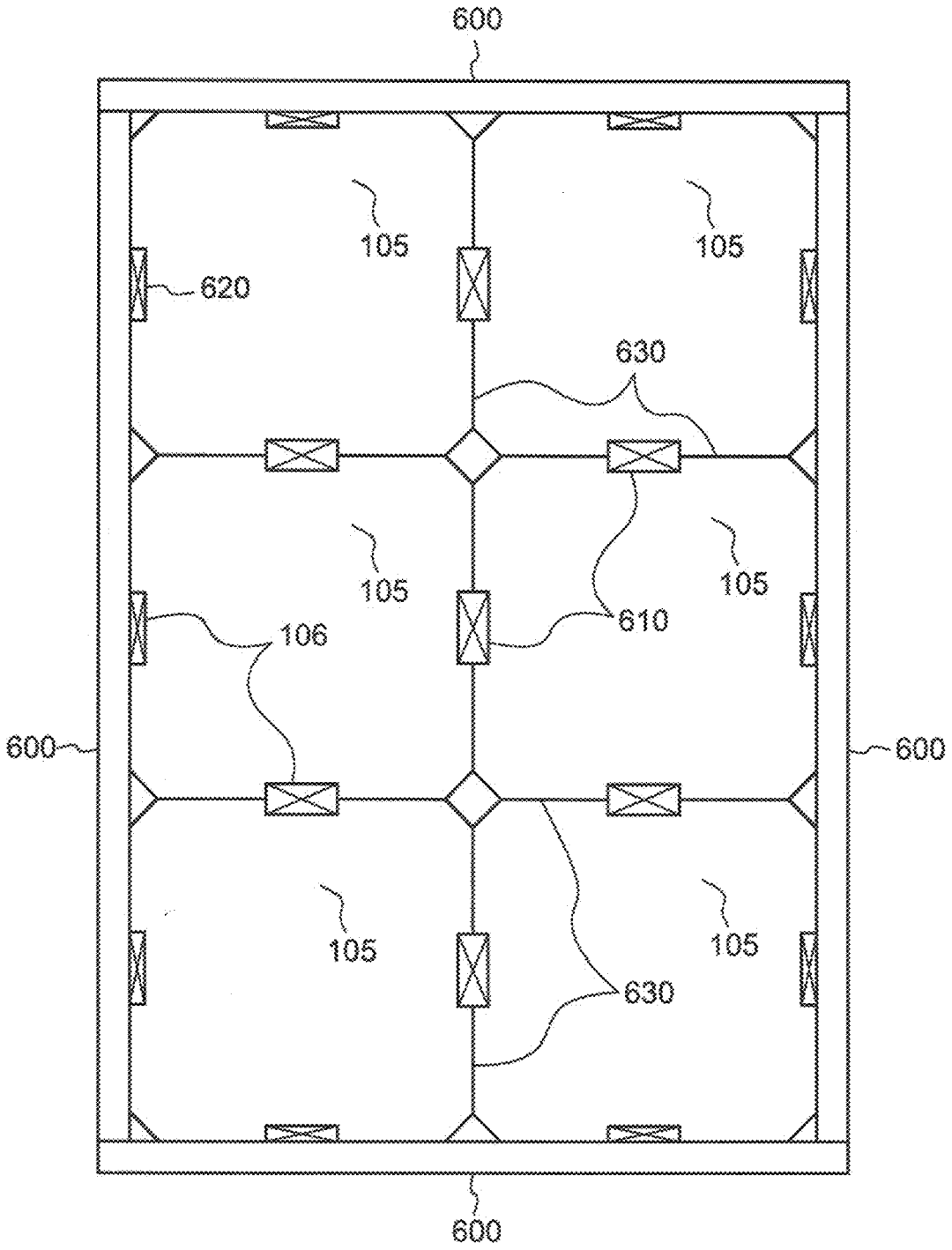
FIG. 11 illustrates multiple ESM units in a variable configuration with external insulation and wall stiffening mechanisms in accordance with an embodiment.

FIG. 11 illustrates a horizontal cross-sectional view of an array of ESM 105 units with insulation 600 and wall stiffeners 610 and 620. Insulation 600 may comprise rigid foam board with cladding or other material with insulation qualities and rigidity. Stiffening boards 610 and 620 are placed in recesses 106 whereas the width of 610 is perhaps twice that of 620. The use of 610 and 620 facilitate reducing bulging in each ESM 105 module due to static fluid pressure and preventing creep of the modules themselves. Additionally, between each module 105 insulating foam board 630 may be placed to isolate the thermal energy level between modules. The use of metal or nylon banding around the perimeter of the modules may be necessary for retention.

Figure 12A:
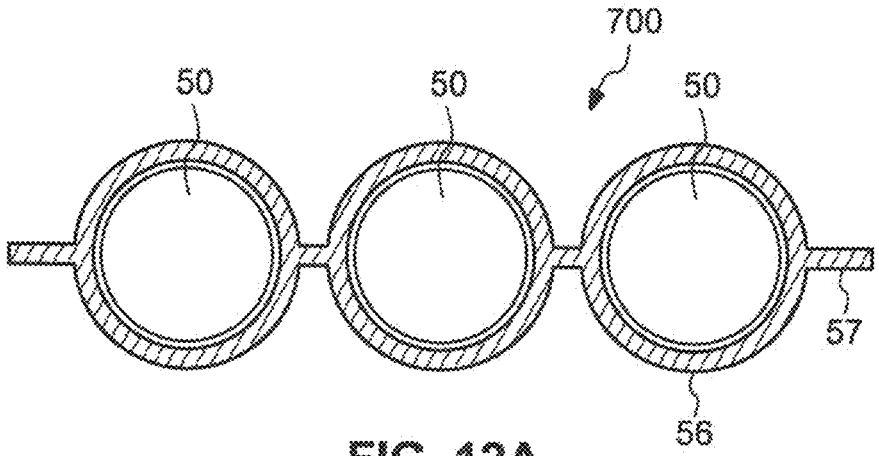
FIGS. 12A, 12B, and 12C illustrate exemplary mechanisms for supporting PCM structures in an ESM in accordance with an embodiment
Figure 12B:
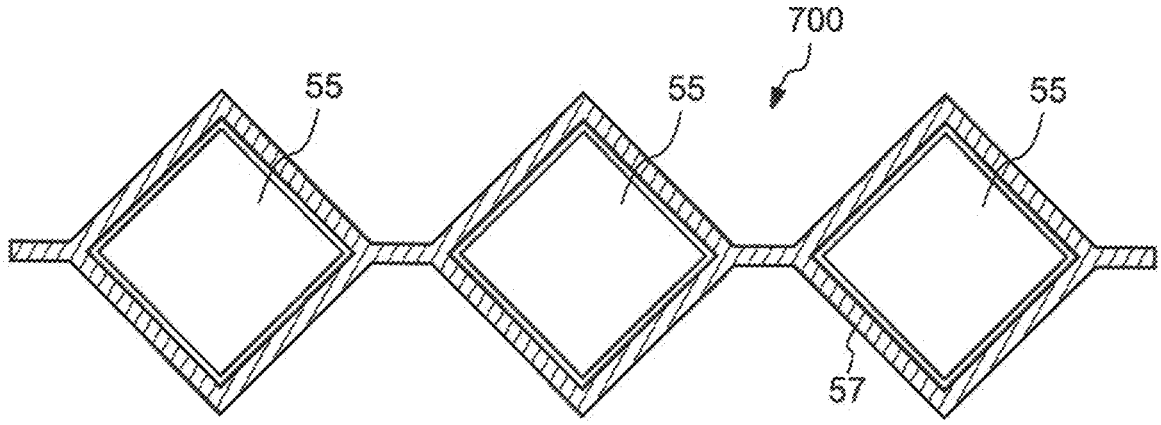
Figure 12C:
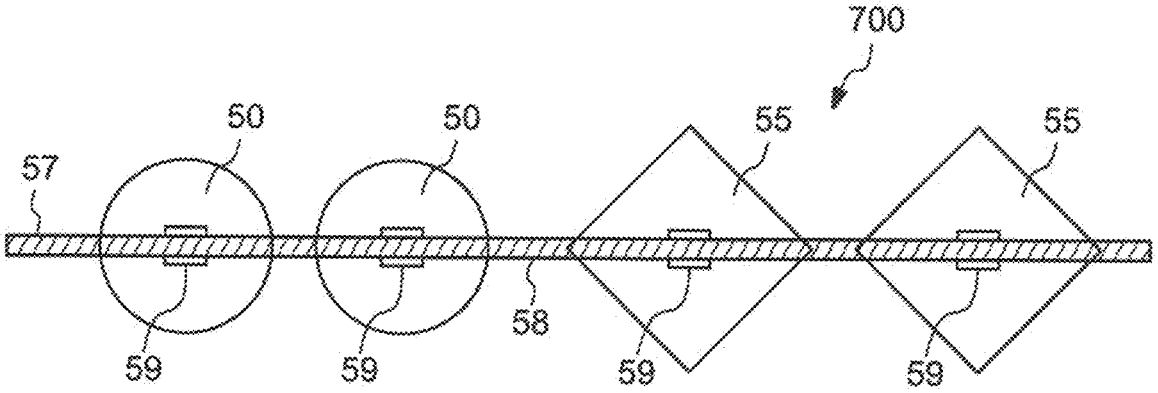

FIGS. 12A-12C illustrate exemplary mechanisms for retaining PCM structures. FIGS. 12A and 12B illustrate tube-racking structures 700 for a circular tube 50 or rectangular tube 55 are depicted. Rack 700 can be a wire rack, as an example, shown as 57 and made up of suitable material such as stainless steel. Rack 700 positions and supports the tubes to allow energy fluid to flow between them and allow the fluid to flow in the space at the bottom of the tubes for even distribution. FIG. 12C is another example of retaining either a circular tube 50 or rectangular tube 55, where rack 700 uses a singular wire 58 that engages with a connection mechanism 59 at the top and bottom of tubes 50 and/or 55. Note that a range of manufactured equivalents and designs can be used for wire rack system 700.

Figure 13:
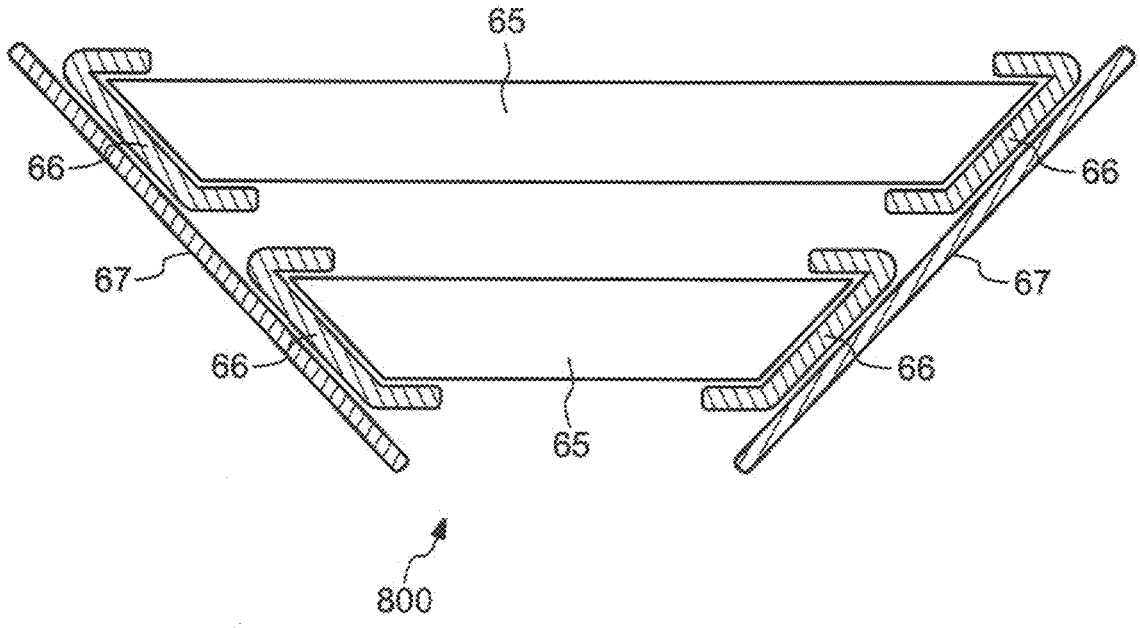
FIG. 13 illustrates a racking means for support of flat rectangular encapsulating containers or plates of wall board in accordance with an embodiment.

FIG. 13 illustrates a rack 800 in which encapsulating plates or wall board 65, as examples, are shown with similar function as the wire racks illustrated in FIGS. 12A-12C. Rack 800 positions encapsulating plates 65 with spacing between and below for even fluid flow and distribution on the sides, top, and bottom. In this example, end brackets 66 are used to retain the ends of the encapsulating plates with a securing wire or bar 67 affixed to end brackets 66. Note that the disclosed embodiments can leverage a range of equivalent structures that achieve substantially similar functionality.

Figure 14:
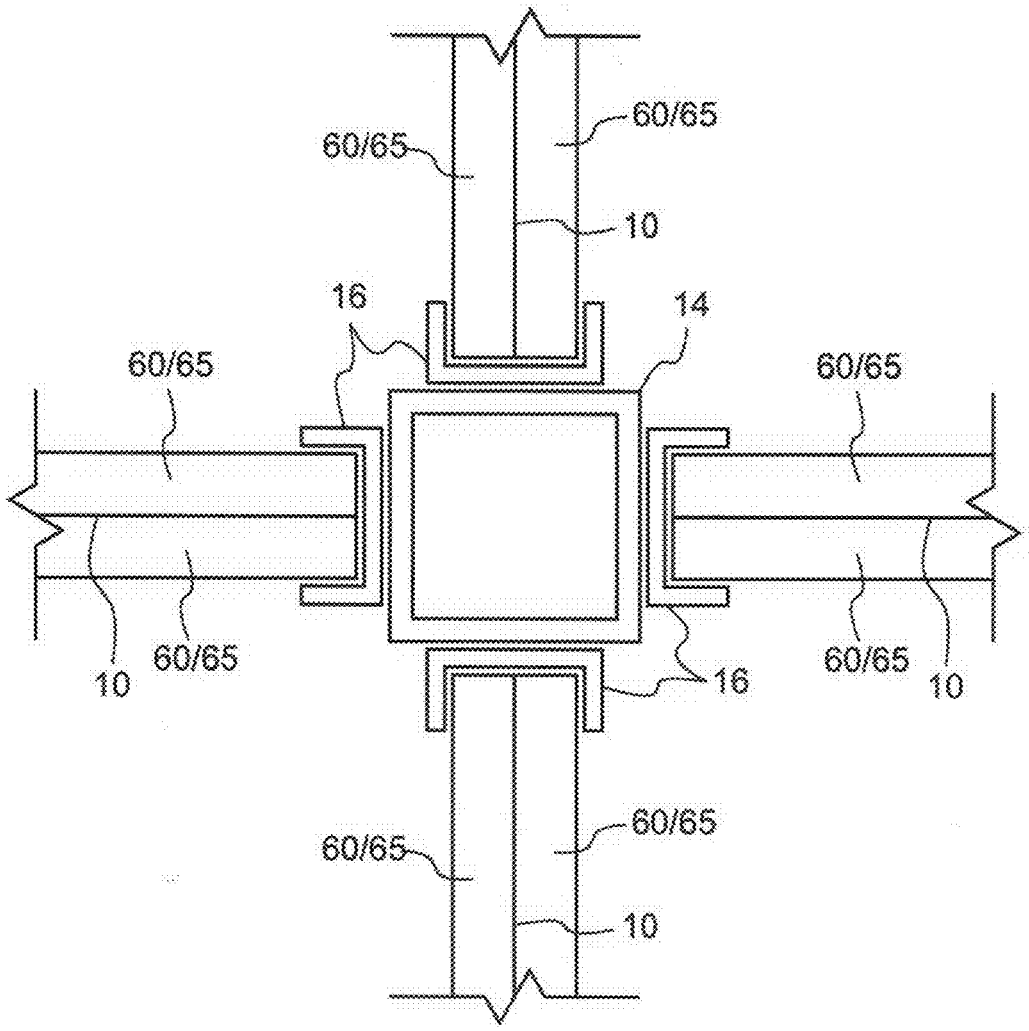
FIG. 14 illustrates an exemplary method of securing chamber partitions at center of a modular ESM unit in accordance with an embodiment.

FIG. 14 illustrates the center post 14 of an ESM as being a square tube. Encapsulated material 60/65 and partition 10 are set into channel brackets 16. All four partitions 10 with encapsulated material 60/65 are connected to center post 14, thereby securing the partitions in place. Channel brackets 16 may be secured to center post 14 by tack welds, screws, rivets or other suitable methods.

Figure 15:
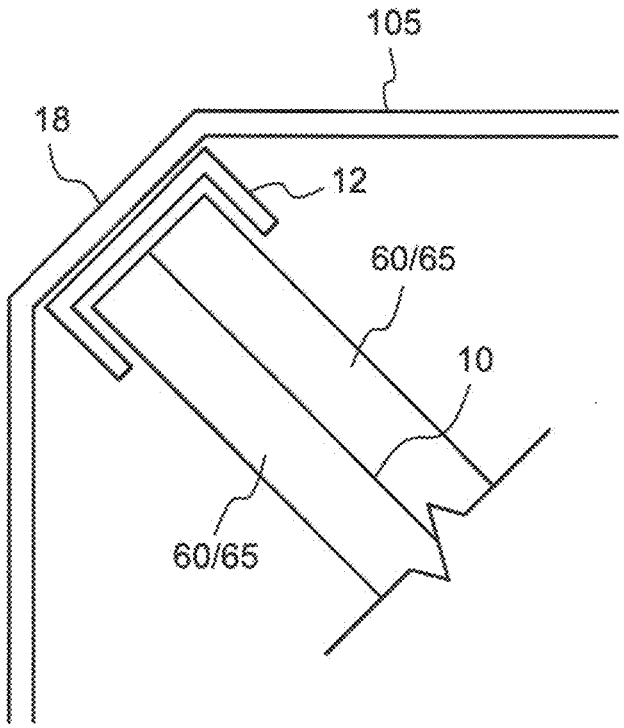
FIG. 15 illustrates an exemplary method of securing chamber partitions at an outer edge of a modular ESM unit in accordance with an embodiment.

FIG. 15 further illustrates the securing encapsulated material 60/65 and partition 10 with a channel bracket 12 affixed to a beveled corner 18 of ESM unit 105. Channel bracket 12 is positioned to the inside of bevel 18 and may or may not be attached to the inside of the beveled corner.

Figure 16:
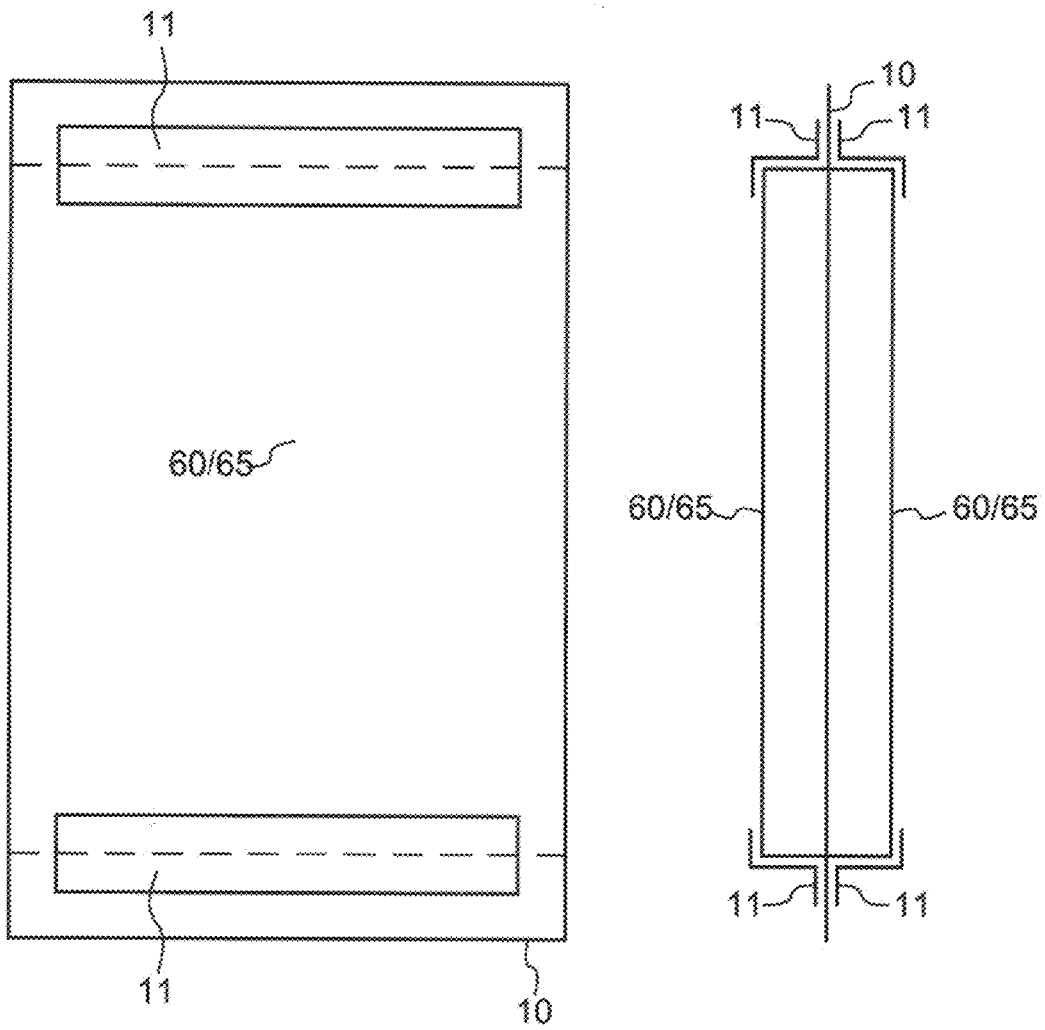
FIG. 16 illustrates a method of affixing encapsulated material to a partition in accordance with an embodiment.

FIG. 16 illustrates the use of "Z" brackets 11 affixed to a partition 10. Encapsulated material 60/65 can be slid into brackets 11 prior to installation. The attachment of "Z" brackets 11 to partition 10 can be accomplished with spot welding, rivets, or screws.

In a four-chamber system (such as the one illustrated in FIGS. 3-9), energy-carrying fluid makes four passes. If the ESM is oriented vertically, in two of the chambers the fluid flows downwardly and in two of the chambers the fluid flows upwardly. The chambers are linked using through wall-penetrations in three walls, with one wall blank (e.g., no openings), to accommodate the velocity movement of the fluid from the inlet into the ESM to the outlet of the ESM. Of the three partition walls with openings, two have penetrations at the bottom and the remaining one has a penetration at the top.

The movement of an energy fluid (e.g., water) through an ESM is achieved using a mechanical pump, which generates velocity pressure on the ESM and its contents. (i.e., dynamic pressure on the sides of the housing and on the PCM-encapsulations and PCM-holding structures in the chambers that is caused by the moving fluid encountering constricted areas, in contrast with static pressure associated with the pressure of stored, non-moving fluid against the housing's walls). Because of the flow restrictions throughout an ESM that are caused by the penetrations, tight spaces between the encapsulating tubes holding PCM, and changes in fluid direction, back pressure develops that also creates static pressure against the outer walls of an ESM. These pressures help balance the flow through an ESM, but maintaining an even flow across the horizontal plane of the ESM may involve techniques and structures that increase flow resistance where the energy-carrying fluid is near the center of the module and decrease resistance in areas where the fluid has to travel farther out to the perimeter of the module in order maintain even flow across the horizontal plane of the ESM (i.e., preventing "short-circuiting," in which fluid takes the shorter path near the center instead of flowing out and exchanging thermal energy near the outside perimeter of the module).

In some embodiments, including voids at the top and bottom of the ESM (i.e., above and below the encapsulating tubes, as illustrated in FIG. 7), facilitates dropping velocity pressure and result in a near-static-pressure condition. An energy-carrying fluid (such as water) will by its nature, when under low pressure and static conditions, even out to a near-constant pressure at a low-vertical-flow profile, hence facilitating temperature blending and equalizing pressure.

Figure 17A:
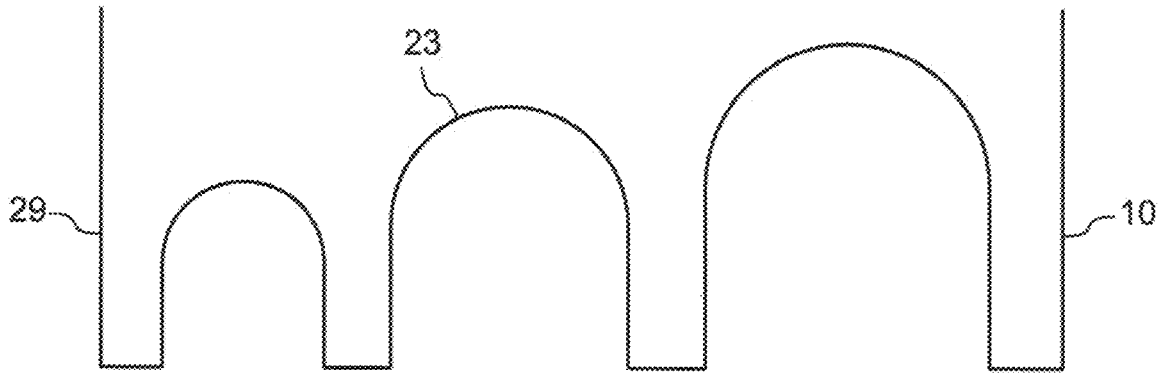
FIGS. 17A, 17B, and 17C illustrates three examples of shaped energy fluid passages that provide balanced flow control between the chambers of an ESM in accordance with an embodiment.
Figure 17B:
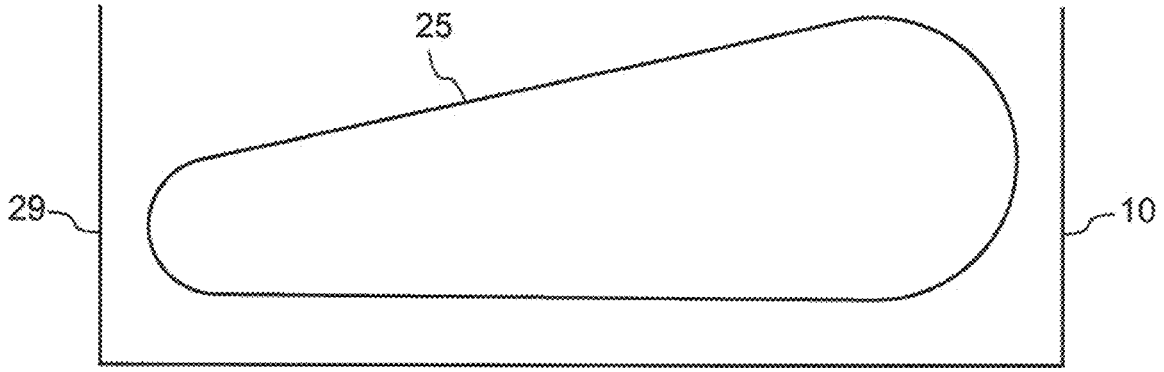
Figure 17C:
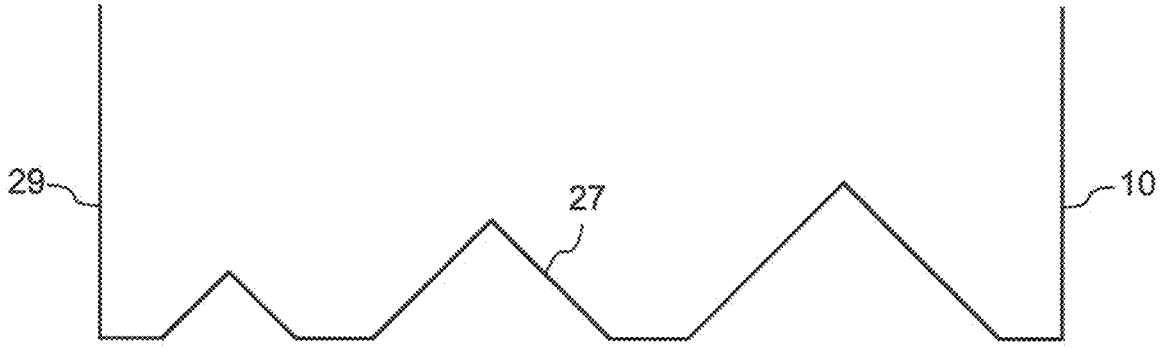

FIGS. 17A-C illustrate representative examples of shaped energy fluid passages located at either the top or bottom of partitions 10 in which the reference of 29 is towards the center point of ESM 105. In FIGS. 4A-4D and 5A-5D such passages are shown as 20, 22, and 24. The increasing size of the series of openings 23 in FIG. 17A, the increasing width of a single opening near the center point 29 towards the outer edge of partition 10 in FIG. 17B, and the increasing size of notches in FIG. 17C from center point 29 towards partition 10 all facilitate balancing velocity pressure in an ESM to reduce short cycling near reference point 29. Making the opening progressively larger towards the perimeter of the ESM balances the flow of the energy fluid between chambers and partition walls 10 and provides a more blended flow of the energy fluid. Note that the described embodiments are not limited to the illustrated shapes, and that a range of shaped openings can be used to achieve similar improvements in energy fluid flow that maximizes energy exchange with the PCM of ESM 105.

In some embodiments, the control logic for a hybrid space-conditioning system (HSCS) (as disclosed in the above-referenced related applications) is further configured to characterize and leverage the one or more ESMs of an SESS as a thermal storage system. For instance, the control logic of the HSCS may be configured with some initial SESS characteristics and parameters (e.g., the number of ESM modules, their PCM configuration and expected operating characteristics, associated sensor options and capabilities, and the available set of valving configurations), and then during operation evaluate the capabilities of the SESS with respect to improving the energy efficiency of the HSCS. For example, the HSCS may during operation determine and track the characteristics for each component ESM to determine if there are any variations between them, and detect any change in PCM behavior over time. For a multi-ESM SESS, the control logic may determine that during the peak summer and winter seasons the HSCS might determine for instance that all of the component ESMs should be charged with cold and warm, respectively. However, if the SESS configuration allows, during the shoulder periods of the year the control logic may be configured to consider and switch between different scenarios of allocating different numbers of ESMs to heat and cold depending on predicted loads to optimize energy efficiency. More specifically, a multi-ESM configuration would enable finer-grained adjustments that benefit both heating and cooling efficiency during time periods in which both are needed (in contrast to only having a binary choice of switching an entire thermal storage from one mode to the other).

In some embodiments, the component ESMs of an SESS may also be configured with different PCMs and/or PCM structures that optimize heat or cold storage. For instance, in a geographic region with predominantly warm weather, a high proportion of the component ESMs may be configured with cold-optimized PCMs, and only a small proportion of the component ESMs would be configured with PCMs optimized towards heating purposes. The control logic for the HSCS may be configured to be aware of this, or may detect such capabilities using diagnostic tests and/or sensing capabilities.

In some embodiments, the HSCS may be configured to measure the temperature change between the input and output of an SESS (and/or individual ESMs), and then adjust the flow rate through the system to modify the residence time of energy fluid in the system to ensure that a specified change in temperature is achieved.

Figure 18:
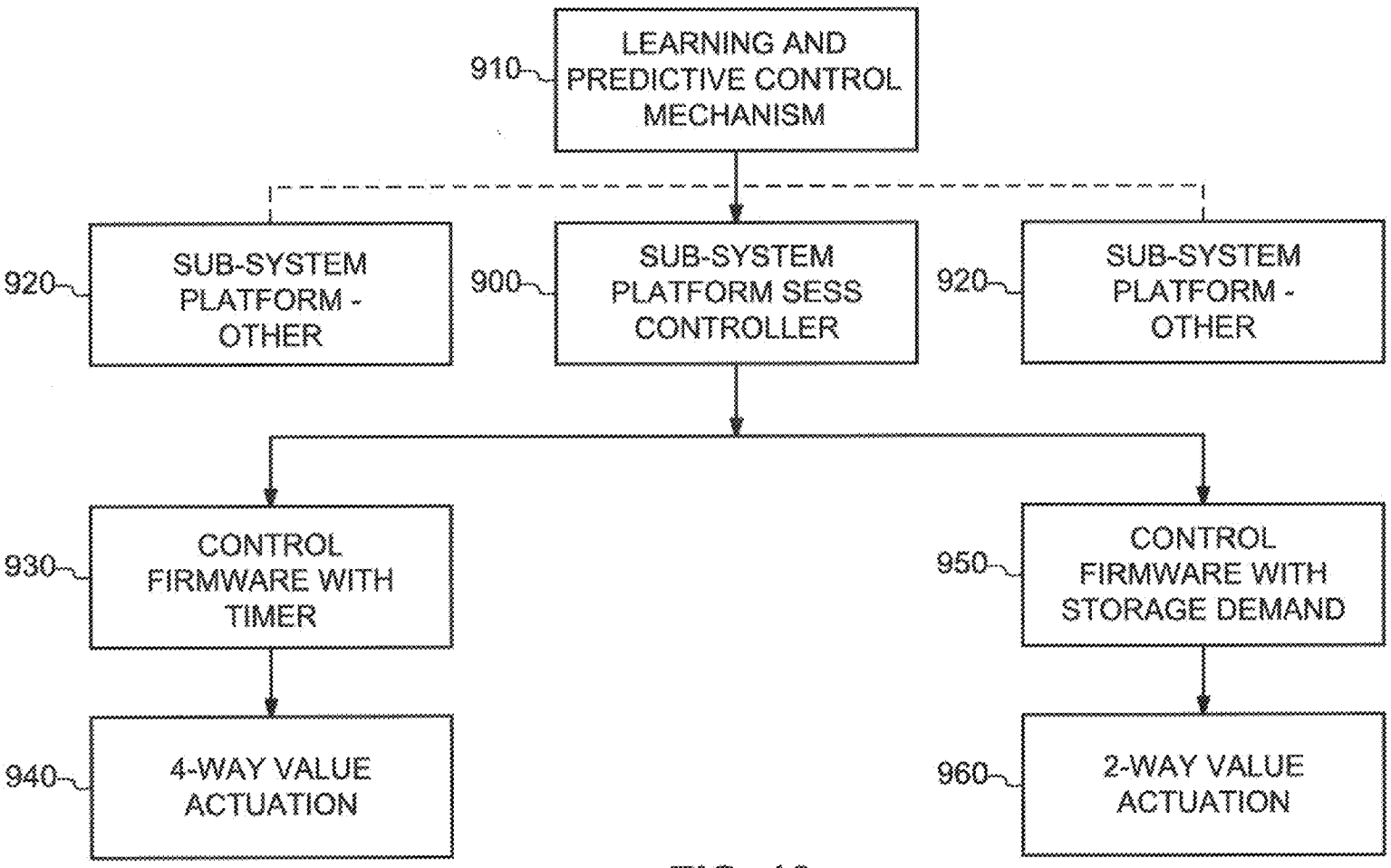
FIG. 18 illustrates a control block diagram in accordance with an embodiment.

FIG. 18 illustrates an exemplary configuration for the control logic for an SESS. From FIG. 1, hot and cold seasonal energy storage system (SESS) 100 will be mechanically, electrically, electronically, and control-wise interconnected with other compatible energy exchange independent systems controlled by a self-learning and predictive control mechanism/logic 910. For instance, the number of modules in the system can be entered manually into an application process. The self-learning and predictive control logic can then determine the next 24 hour operation of the system, for example determining the number or combination of modules needed to meet the demand. The control logic will also decide the most efficient use of SESS 100 either as a hybrid heat pump during cool and cold seasons or for hot water heating. SESS 100 may therefore be controlled through a sub-platform controller 900. Other related sub-platforms 920 may include other aspects of the HSCS or peripheral accessories and functionalities that leverage the SESS. SESS controller 900 has two primary functions as a slave controller based on the energy storage or disbursement requirement of control mechanism 910. First, a controller with a timer 930 operates a 4-way actuatable reversing valve 110 for a calculated time length through firmware circuit 940. Second, a controller with energy demand requirements 950 operates selectable 2-way actuatable valves 112*a*-112*l* valves through firmware circuit 960. Sensors provide data to the learning and predictive control mechanism 910.

Figure 19:
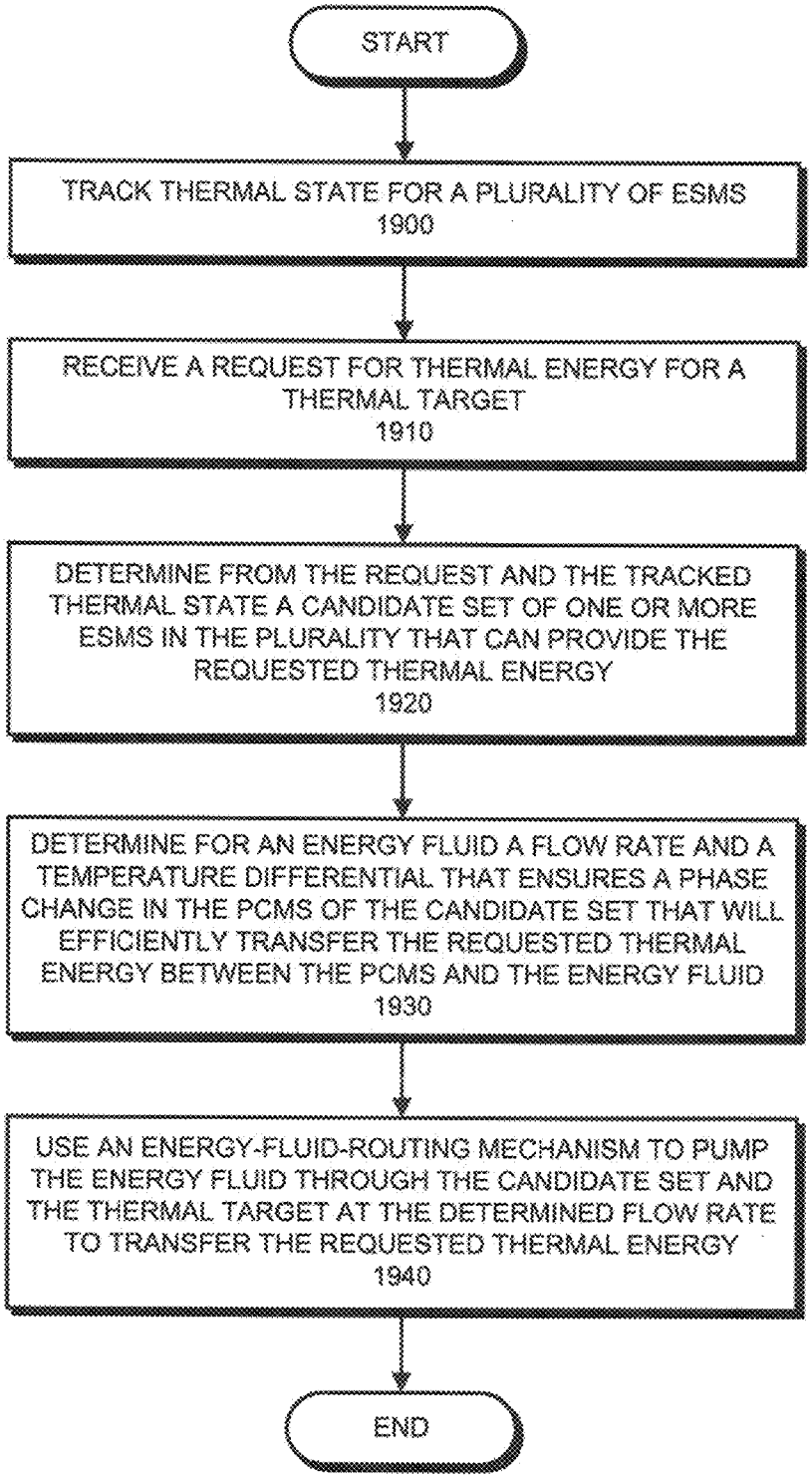
FIG. 19 presents a flow chart that illustrates the process of accessing a SESS in accordance with an embodiment.

FIG. 19 presents a flow chart that illustrates the process of accessing a SESS in accordance with an embodiment. The SESS comprises a plurality of ESMs, wherein each ESM comprises a plurality of chambers that contain PCM that can store thermal energy. During operation, a control mechanism for the SESS tracks thermal state for the plurality of ESMs (operation 1900). Subsequently, the control mechanism receives a request for thermal energy for a thermal target (e.g., at least one of an energy sink and an energy source) (operation 1910). The control mechanism determines from the request and the tracked thermal state a candidate set of one or more ESMs in the plurality that can provide the requested thermal energy (operation 1920), and determines for an energy fluid a flow rate and a temperature differential that ensures a phase change in the PCMs of the candidate set that will efficiently transfer the requested thermal energy between the PCMs and the energy fluid (operation 1930). The system then uses an energy-fluid-routing mechanism for the SESS to pump the energy fluid through the candidate set and the thermal target at the determined flow rate to transfer the requested thermal energy (operation 1940).

Although some variations have been described and illustrated in detail above, other modifications or additions are possible. In particular, further features and/or variations can be provided in addition to those set forth herein. For example, the implementations described above can be directed to various combinations and sub combinations of the disclosed features and/or combinations and sub combinations of several further features disclosed above. In addition, the logic flows depicted in the accompanying figures and/or described herein do not necessarily require the particular order shown, or sequential order, to achieve desirable results. Other implementations may be within the scope of the following claims.

What is claimed is:

1. A modular thermal-energy storage and transfer system, comprising:

a plurality of energy-storage modules (ESMs), wherein a given ESM in the plurality comprises a plurality of chambers that contain phase-change material (PCM) that stores thermal energy;

an energy fluid routed through the plurality of ESMs, wherein the temperature of the energy fluid triggers a phase change in the PCM of the given ESM to transfer thermal energy between the PCM and the energy fluid; and a control mechanism that is configured to adjust the flow of the energy fluid through the given ESM to efficiently achieve a target temperature change in at least one of the energy fluid and the PCM;

wherein the control mechanism adjusts the flow rate of the energy fluid through the PCM of the given ESM to maximize a temperature difference between the energy fluid and the PCM in the given ESM to enable a uniform phase change across the PCM of the given ESM; and wherein the plurality of ESMs are connected using an interconnecting energy fluid routing mechanism that comprises one or more actuatable valves that the control mechanism configures to selectively control the flow and flow rate of the energy fluid through the plurality of ESMs.

2. The modular thermal-energy storage and transfer system of claim 1, wherein the given ESM comprises a module-housing body comprising:

an external vertical side surface with a top and bottom surface;

an internal partition that bisects the module-housing body into a first fluid chamber and an adjacent fluid chamber, wherein the internal partition has an opening that facilitates energy fluid transfer between the first internal fluid chamber and the adjacent fluid chamber;

an inlet that penetrates the module-housing body into the first fluid chamber;

an outlet that penetrates the module-housing body into the adjacent fluid chamber;

a first set of PCM encapsulated in the first fluid chamber; and a second set of PCM encapsulated in the adjacent fluid chamber;

wherein the energy fluid is injected into the given ESM via the inlet, flows through the first fluid chamber exchanging thermal energy with the first set of PCM, flows through the opening to the adjacent fluid chamber, flows through the adjacent fluid chamber exchanging thermal energy with the second set of PCM, and then flows through the outlet out of the given ESM; and wherein the flow of the energy fluid in the adjacent fluid chamber is opposite in direction to fluid flow in the first fluid chamber.

3. The modular thermal-energy storage and transfer system of claim 1, wherein the given ESM comprises a module-housing body comprising:

four equal vertical surface sides with a top and bottom surface;

a partition structure that diagonally quadrisects the module-housing body into four fluid chambers that comprise a first fluid chamber, a second fluid chamber, a third fluid chamber, and a fourth fluid chamber, wherein each of the four adjacent fluid chambers comprises:

encapsulated PCM secured in a support structure;

a first fluid-mixing area above the support structure; and a second fluid-mixing area below the support structure;

an inlet that penetrates the module-housing body into the first fluid chamber; and an outlet that penetrates the module-housing body into the fourth fluid chamber;

wherein a first section of the partition wall separating the first fluid chamber and the second fluid chamber is porous to fluid flow;

wherein a second section of the partition wall separating the third fluid chamber and the fourth fluid chamber is porous to fluid flow;

wherein the partition structure comprises a first opening that facilitates fluid transfer between the second fluid chamber and the third fluid chamber;

wherein the energy fluid is injected into the given ESM via the inlet, flows through the first fluid chamber exchanging thermal energy with the first chamber's PCM, flows through the porous first section; flows through the second fluid chamber exchanging thermal energy with the second chamber's PCM, flows through the first opening to the third fluid chamber, flows through the third fluid chamber exchanging thermal energy with the third chamber's PCM, flows through the second section to the fourth fluid chamber, flows through the fourth fluid chamber exchanging thermal energy with the fourth chamber's PCM, and then flows through the outlet out of the given ESM;

wherein the flow of the energy fluid in the first and second fluid chamber is opposite in direction to fluid flow in the third fluid chamber and the fourth fluid chamber; and wherein the first section and second section provide structural support to the given ESM without impeding fluid flow, thereby making the given ESM substantially function as a two-chamber structure.

4. The modular thermal-energy storage and transfer system of claim 1, wherein the interconnecting energy-fluid-conveying system comprises an actuatable valve that facilitates reversing fluid flows through the inlets and outlets of one or more of the ESMs; and wherein the control mechanism is configured to reverse the flow of the energy fluid through the given ESM at least once to increase the residence time of the energy fluid within the given ESM and thereby increase the uniformity of a phase change for the PCM in the given ESM.

5. The modular thermal-energy storage and transfer system of claim 1, wherein the plurality of ESMs comprises a heterogeneous set of independent ESMs with different PCM types and chamber configurations, wherein the control mechanism is configured to:

track the state and characteristics of each ESM in the plurality of ESMs; and adjust the flow velocity of the energy fluid through the given ESM in the plurality based on characteristics of the PCM type and PCM layout in the given ESM to customize the residence time of the energy fluid in the given ESM to maximize thermal transfer and trigger a PCM state change in the given ESM.

6. The modular thermal-energy storage and transfer system of claim 1, wherein a set of isolation valves at the inlets and outlets of the plurality of ESMs facilitate selectively routing the energy fluid through segregated subsets of the plurality of ESMs; and wherein the control mechanism configures the set of isolation valves to store and access two or more distinct temperature levels of stored thermal energy across segregated subsets of the plurality of ESMs.

7. The modular thermal-energy storage and transfer system of claim 1, wherein the given ESM comprises a module-housing body comprising:

four equal vertical surface sides with a top and bottom surface;

a partition structure that diagonally quadrisects the module-housing body into four fluid chambers that comprise a first fluid chamber, a second fluid chamber, a third fluid chamber, and a fourth fluid chamber, wherein each of the four adjacent fluid chambers comprises:

encapsulated phase-change material (PCM) secured in a support structure;

a first fluid-mixing area above the support structure; and a second fluid-mixing area below the support structure;

an inlet that penetrates the module-housing body into the first fluid chamber;

an outlet that penetrates the module-housing body into the fourth fluid chamber;

wherein the partition structure comprises:

a first opening that facilitates fluid transfer between the first fluid chamber and the second fluid chamber;

a second opening that facilitates fluid transfer between the second fluid chamber and the third fluid chamber; and a third opening that facilitates fluid transfer between the third fluid chamber and the fourth fluid chamber;

wherein the energy fluid is injected into the given ESM via the inlet, flows through the first fluid chamber exchanging thermal energy with the first chamber's PCM, flows through the first opening to the second fluid chamber, flows through the second fluid chamber exchanging thermal energy with the second chamber's PCM, flows through the second opening to the third fluid chamber, flows through the third fluid chamber exchanging thermal energy with the third chamber's PCM, flows through the third opening to the fourth fluid chamber, flows through the fourth fluid chamber exchanging thermal energy with the fourth chamber's PCM, and then flows through the outlet out of the given ESM;

wherein the flow of the energy fluid in the first fluid chamber and the third fluid chamber is opposite in direction to fluid flow in the second fluid chamber and the fourth fluid chamber.

8. The modular thermal-energy storage and transfer system of claim 7, wherein the openings between chambers are located at opposing extremes of each adjacent chamber to maximize a fluid flow path through the given ESM, thereby maximizing the path of the energy fluid through the given ESM and the energy transfer between the energy fluid and the PCM in the given ESM.

9. The modular thermal-energy storage and transfer system of claim 7, wherein the openings in the partition structure that separates the chambers comprise increase in area from the center of the module-housing body towards the outside perimeter of the module-housing body; and wherein increasing the area of the openings in the partition structure routes the energy fluid evenly across changing velocity and static pressures throughout the given ESM to balance fluid flows and thermal energy transfer through the chambers of the given ESM.

10. The modular thermal-energy storage and transfer system of claim 7:

wherein the PCM in the given ESM is substantially positioned in each energy fluid congruent chamber by a retaining support system;

wherein the retaining support system, the shape of the PCM, and the layout of the PCM in each chamber are configured to maximize the surface area of the PCM that is exposed the energy fluid and achieve a desired energy fluid flow that maximizes energy transfer between the PCM and the energy fluid.

11. The modular thermal-energy storage and transfer system of claim 7, wherein the PCM in the given ESM comprises a range of geometric shapes and configurations to optimize the amount and layout of PCM within and between chambers of the given ESM.

12. The modular thermal-energy storage and transfer system of claim 1, wherein the given ESM comprises:

at least one of a cross sectional round shape and a rectangular geometric shape;

vertical walls with aligning indentations that create structural stiffening capabilities using separate, exterior, substantially-rigid material placed within the indentations to counter liquid static pressure created within the given ESM, wherein substantially-rigid material placed within the indentations of multiple ESMs facilitates creating a locking effect between the ESMs; and a banding material substantially placed around the given ESM and one or more neighboring ESMs to retain the substantially-rigid material in place and substantially lock together and structurally support multiple ESMs in a system.

* * * * *